US006481531B1

(12) United States Patent
Nagura et al.

(10) Patent No.: US 6,481,531 B1
(45) Date of Patent: Nov. 19, 2002

(54) ELEVATOR COMMUNICATIONS APPARATUS

(75) Inventors: Hirokazu Nagura, Hitachi (JP); Hiromi Inaba, Hitachinaka (JP); Sadao Hokari, Hitachinaka (JP); Atsuya Fujino, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/955,995

(22) Filed: Sep. 20, 2001

(30) Foreign Application Priority Data

Apr. 27, 2001 (JP) ..... 2001-130579

(51) Int. Cl.[7] ..... B66B 1/50
(52) U.S. Cl. ..... 187/247; 187/391; 187/413
(58) Field of Search ..... 187/247, 391, 187/393, 395, 397, 399, 413, 414, 900, 290

(56) References Cited

U.S. PATENT DOCUMENTS 3,203,506 A * 8/1965 Cummins ..... 187/391
4,979,593 A * 12/1990 Watanabe et al. ..... 104/112
5,732,795 A * 3/1998 McCarthy et al. ..... 187/250
5,736,692 A * 4/1998 Lumme et al. ..... 187/247
6,408,986 B1 * 6/2002 Ayano et al. ..... 187/290

FOREIGN PATENT DOCUMENTS

| | | | | |
|---|---|---|---|---|
| JP | 60102377 | | 6/1985 | |
| JP | 63282076 | | 11/1988 | |
| JP | 01060586 | A * | 3/1989 | ..... B66B/3/00 |
| JP | 01256485 | A * | 10/1989 | ..... 187/413 |
| JP | 0346979 | A * | 2/1991 | ..... B66B/3/00 |
| JP | 3046979 | | 2/1991 | |
| JP | 6092560 | | 4/1994 | |
| JP | 01150505 | A * | 6/1999 | ..... B66B/3/00 |
| JP | 2001341952 | A * | 12/2001 | ..... B66B/3/00 |

* cited by examiner

*Primary Examiner*—Jonathan Salata
(74) *Attorney, Agent, or Firm*—Crowell & Moring LLP

(57) ABSTRACT

The number of electrical wires in the car is reduced by radio communications between the operation panel and terminal. Furthermore, reliability and dependability of communications are improved because the operation panel and terminal communicate with each other at a comparatively short distance.

13 Claims, 29 Drawing Sheets

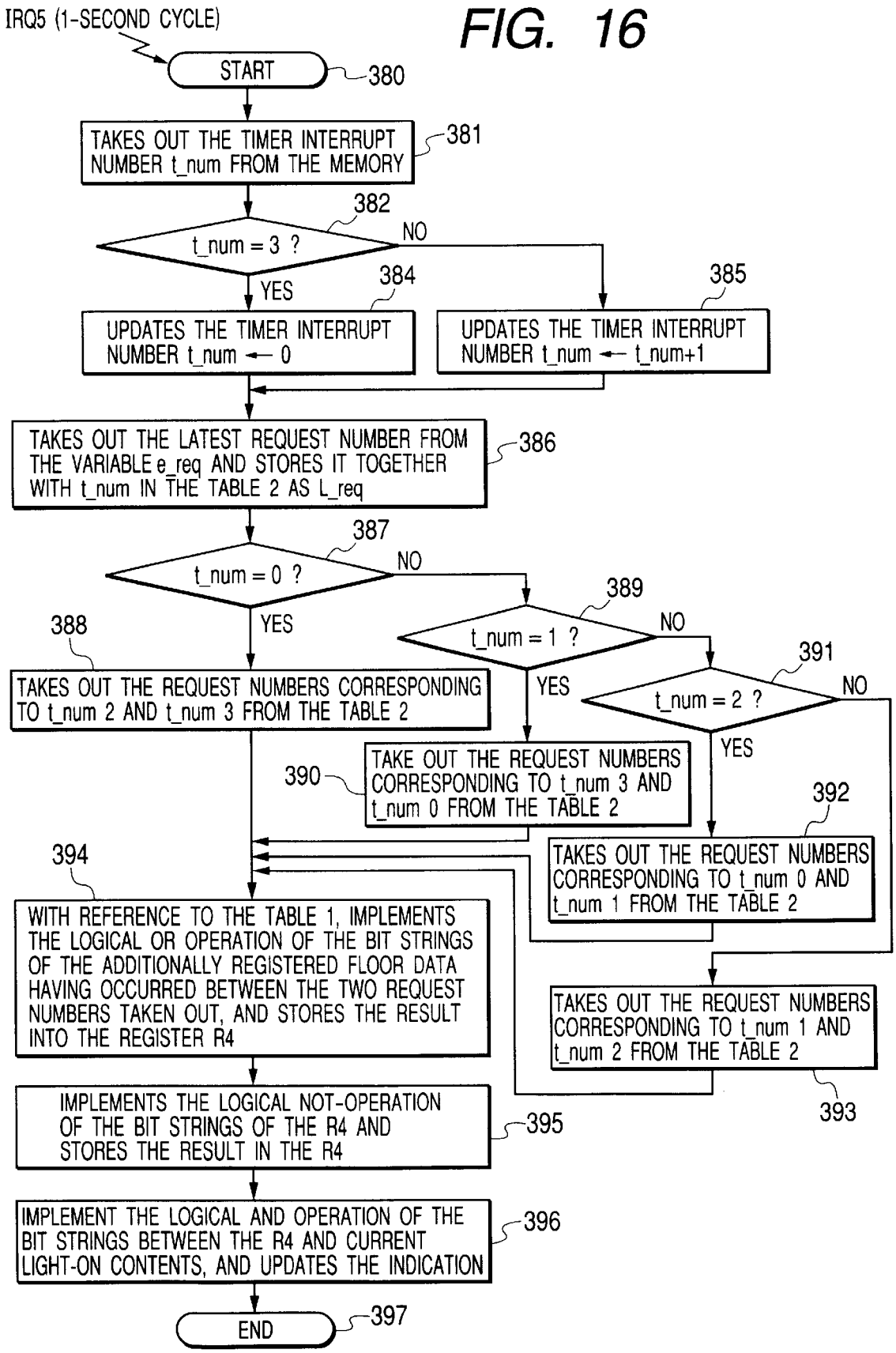
FIG. 16
IRQ5 (1-SECOND CYCLE)
START
380
TAKES OUT THE TIMER INTERRUPT NUMBER t_num FROM THE MEMORY
381
382
t_num = 3 ?
NO
YES
384
385
UPDATES THE TIMER INTERRUPT NUMBER t_num ← 0
UPDATES THE TIMER INTERRUPT NUMBER t_num ← t_num+1
TAKES OUT THE LATEST REQUEST NUMBER FROM THE VARIABLE e_req AND STORES IT TOGETHER WITH t_num IN THE TABLE 2 AS L_req
386
387
t_num = 0 ?
NO
YES
389
t_num = 1 ?
NO
YES
388
TAKES OUT THE REQUEST NUMBERS CORRESPONDING TO t_num 2 AND t_num 3 FROM THE TABLE 2
391
t_num = 2 ?
NO
YES
390
TAKE OUT THE REQUEST NUMBERS CORRESPONDING TO t_num 3 AND t_num 0 FROM THE TABLE 2
392
TAKES OUT THE REQUEST NUMBERS CORRESPONDING TO t_num 0 AND t_num 1 FROM THE TABLE 2
394
WITH REFERENCE TO THE TABLE 1, IMPLEMENTS THE LOGICAL OR OPERATION OF THE BIT STRINGS OF THE ADDITIONALLY REGISTERED FLOOR DATA HAVING OCCURRED BETWEEN THE TWO REQUEST NUMBERS TAKEN OUT, AND STORES THE RESULT INTO THE REGISTER R4
TAKES OUT THE REQUEST NUMBERS CORRESPONDING TO t_num 1 AND t_num 2 FROM THE TABLE 2
393
IMPLEMENTS THE LOGICAL NOT-OPERATION OF THE BIT STRINGS OF THE R4 AND STORES THE RESULT IN THE R4
395
IMPLEMENT THE LOGICAL AND OPERATION OF THE BIT STRINGS BETWEEN THE R4 AND CURRENT LIGHT-ON CONTENTS, AND UPDATES THE INDICATION
396
END
397

FIG. 17

TABLE 1

| REQUEST NUMBER | ADDITIONALLY REGISTERED FLOOR |
|---|---|
| 0 | 00000000000000000000000000001000 |
| 1 | 00000000000000000000000010100000 |
| 2 | 00000000000000000000000001000000 |
| 3 | 00000000000000000000000000010000 |
| ⋮ | ⋮ |
| 254 | 00000000000000000000000000000100 |
| 255 | 00000000000000000000000000000001 |

FIG. 18

TABLE 2

| TIMER INTERRUPT NUMBER (t_num) | LATEST REQUEST NUMBER (L_req) |
|---|---|
| 0 | (L_req0=) 1 |
| 1 | (L_req1=) 1 |
| 2 | (L_req2=) 2 |
| 3 | (L_req3=) 4 |

FORMAT OF ADDITIONAL REGISTRATION COMPLETION SIGNAL

FORMAT OF REGISTERED FLOOR LIGHT-OFF SIGNAL

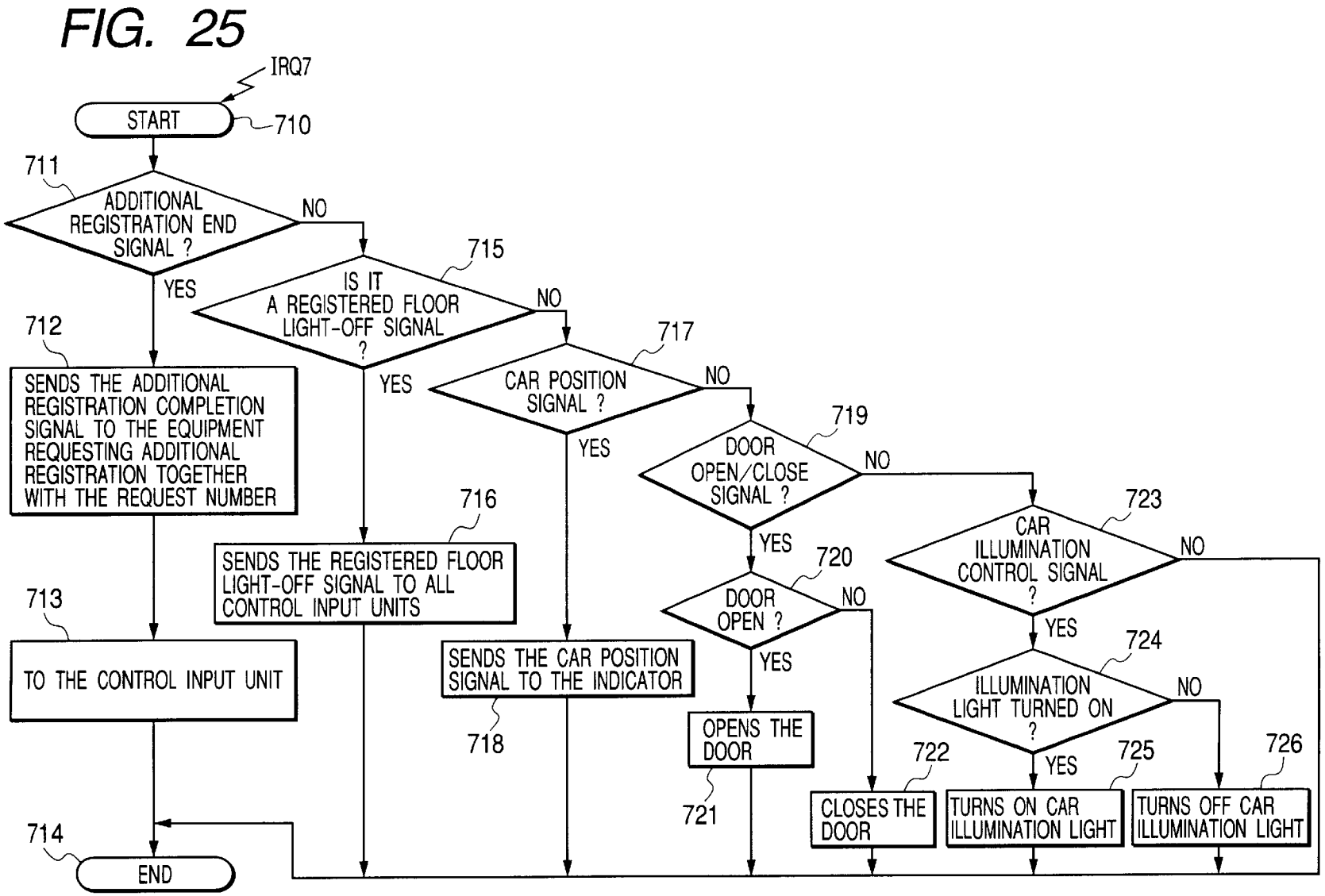
FIG. 25
IRQ7
710
START
711
ADDITIONAL REGISTRATION END SIGNAL ?
YES
NO
712
SENDS THE ADDITIONAL REGISTRATION COMPLETION SIGNAL TO THE EQUIPMENT REQUESTING ADDITIONAL REGISTRATION TOGETHER WITH THE REQUEST NUMBER
713
TO THE CONTROL INPUT UNIT
714
END
715
IS IT A REGISTERED FLOOR LIGHT-OFF SIGNAL ?
YES
NO
716
SENDS THE REGISTERED FLOOR LIGHT-OFF SIGNAL TO ALL CONTROL INPUT UNITS
717
CAR POSITION SIGNAL ?
YES
NO
718
SENDS THE CAR POSITION SIGNAL TO THE INDICATOR
719
DOOR OPEN/CLOSE SIGNAL ?
YES
NO
720
DOOR OPEN ?
YES
NO
721
OPENS THE DOOR
722
CLOSES THE DOOR
723
CAR ILLUMINATION CONTROL SIGNAL ?
YES
NO
724
ILLUMINATION LIGHT TURNED ON ?
YES
NO
725
TURNS ON CAR ILLUMINATION LIGHT
726
TURNS OFF CAR ILLUMINATION LIGHT

DATA FORMAT RECEIVED BY INDICATOR

FORMAT FOR CAR ILLUMINATION CONTROL SIGNAL

| 900 | 901 | 902 | 903 |
|---|---|---|---|
| RECEIVER | SENDER | DATA TYPE (RETURN REQUEST SIGNAL) | RETURN REQUEST CODE |

FORMAT FOR REPLY REQUEST SIGNAL

ELEVATOR COMMUNICATIONS APPARATUS

BACKGROUND OF THE INVENTION

The present invention related to an elevator communications apparatus.

Generally, the operation panel inside an elevator car comprises a control input unit provided with destination floor registration buttons and their response lights and an indicator installed on the top position in the car to indicate the current position of the car. In the prior art, the control input unit and indicator are embedded in a hole formed on the wall of a car. Many wires are led out of each operation panel according to the number of destination floor registration buttons, response lights and indicator lights, and are connected to the appliance box on the top of the car at the ratio of 1 to 1.

FIG. 3 is an external view of the control input according to the prior art , where (a) is a front view, and (b) is a side view. In FIG. 3, numerals 24 to 31 denote destination floor registration buttons and registered floor response lights. Numeral 22 indicates a door-opening request button, 23 a door-closing request button, 21 a maintenance personnel calling button, 20 a speaker and a microphone, 33 a cover for maintenance personnel, 34 a decorative panel, 36 a control input unit proper, 35 a car wall, and 37 wiring.

FIG. 4 is an external view representing an indicator according to the prior art, where (a) is a front view, and (b) is a side view. In FIG. 4, numerals 51 to 58 denote position indicator lights, and 50 and 59 show operation direction indicator lights. Numeral 60 indicates a decorative panel, 61 an indicator proper, 35 a car wall, and 37 wiring.

According to the prior art, the operation panel proper including the control input unit and indicator are embedding in the car wall except for the decorative panel to ensure that wires are not directly visible in the car.

The following describes the arrangement and operation of the elevator according to the prior art with reference to FIG. 2:

In FIG. 2, numeral 1 denotes elevator car, 2 a hoist-way wall, 3 an appliance box, 5 a controller, 4 a tail code for connection between an appliance box 3 and controller 5, 6 a sheave, 7 an illuminating light in a car, 8 and 9 control input units, 10 an indicator, and 15 a wire connecting between an operation panel including the control input units 8 and 9 and indicator 10, and an appliance box 3.

If a passenger presses a destination floor registration button on the control input units 8 and 9, a change occurs in the voltage of the cable corresponding to the wiring 15. This change is fed to the microcomputer in the appliance box connected to the wiring 15, thereby determining the destination floor registration button have been pressed. Then the destination floor registration signal is sent to the controller 5 through tail code 4. The controller 5 in response to this signal operates the car according to the contents of the destination floor registration. Further, the appliance box supplies power to the wiring connected to the registered floor response light corresponding to the destination floor registration button having been pressed, and turns on the registered floor response light.

As explained above, signals are exchanged between the operation panel in the car of the elevator and appliance box by wiring.

As disclosed in the Japanese application patent Laid-Open publication No. Sho 60-102377 and the Japanese application patent Laid-Open publication No. Sho 63-282076, efforts to minimize use of wiring by use of radio communications have already been made regarding the wiring between a car and machine room. Further, an art for allowing communications between the operation panel in the car and elevator controller by radio (infrared ray) is disclosed in the Japanese application patent Laid-Open publication No. Hei 06-92560. Further, the art of minimizing the use of a wire through radio communications between the passenger entrance indicator of the elevator and machine room is disclosed in the Japanese application patent Laid-Open publication No. Hei 03-46979.

In the prior arts described above, wiring is made between the operation panel and appliance box using the wires in the numbers corresponding to the numbers of destination floor registration buttons, registered floor response lights and car position indicator lights at a one-to-one ratio. When there is an increase in the number of floors in a building where the elevator is installed, the number of wires has to be increase in proportion, with the result that much time and labor must be spent on wiring work. Moreover, to ensure that the wires to be led out of the operation panel are not visible in the car, the operation panel has to be embedded in the hole of the car wall. This requires holes to be formed on the car wall. Not only that, if the installation position of the operation panel is to be changed for some reason, or if the interior of the car is to be renewed, the holes must be filled or the entire car wall must be replaced by a new one. This has led to a cost increase so far.

SUMMARY OF THE INVENTION

The object of the present invention is to provide an elevator communications apparatus capable of minimizing the number of wires used in the car, thereby solving the problems given above.

One means of solving these problems is to provide a terminal which performs radio communications with an operation panel installed in the elevator car at a comparatively short distance by connecting between the operation panel and an elevator controller.

This means allows radio communications between operation panel in the car and the terminal, thereby reducing the number of wires used in the car. Furthermore, communication is carried out at a comparatively short distance between the operation panel and terminal. This reduces the influence of noise and improves reliability or dependability of communications.

BRIEF DESCRIPTION OF THE DRAWINGS

FIG. 16 shows processing to be performed at the time of timer interrupt;

FIG. 17 shows the format of the table;

FIG. 18 shows the format of the table;

FIG. 25 shows the processing to be performed when the radio terminal is interrupted;

DETAILED DESCRIPTION OF THE INVENTION

Figure 1:
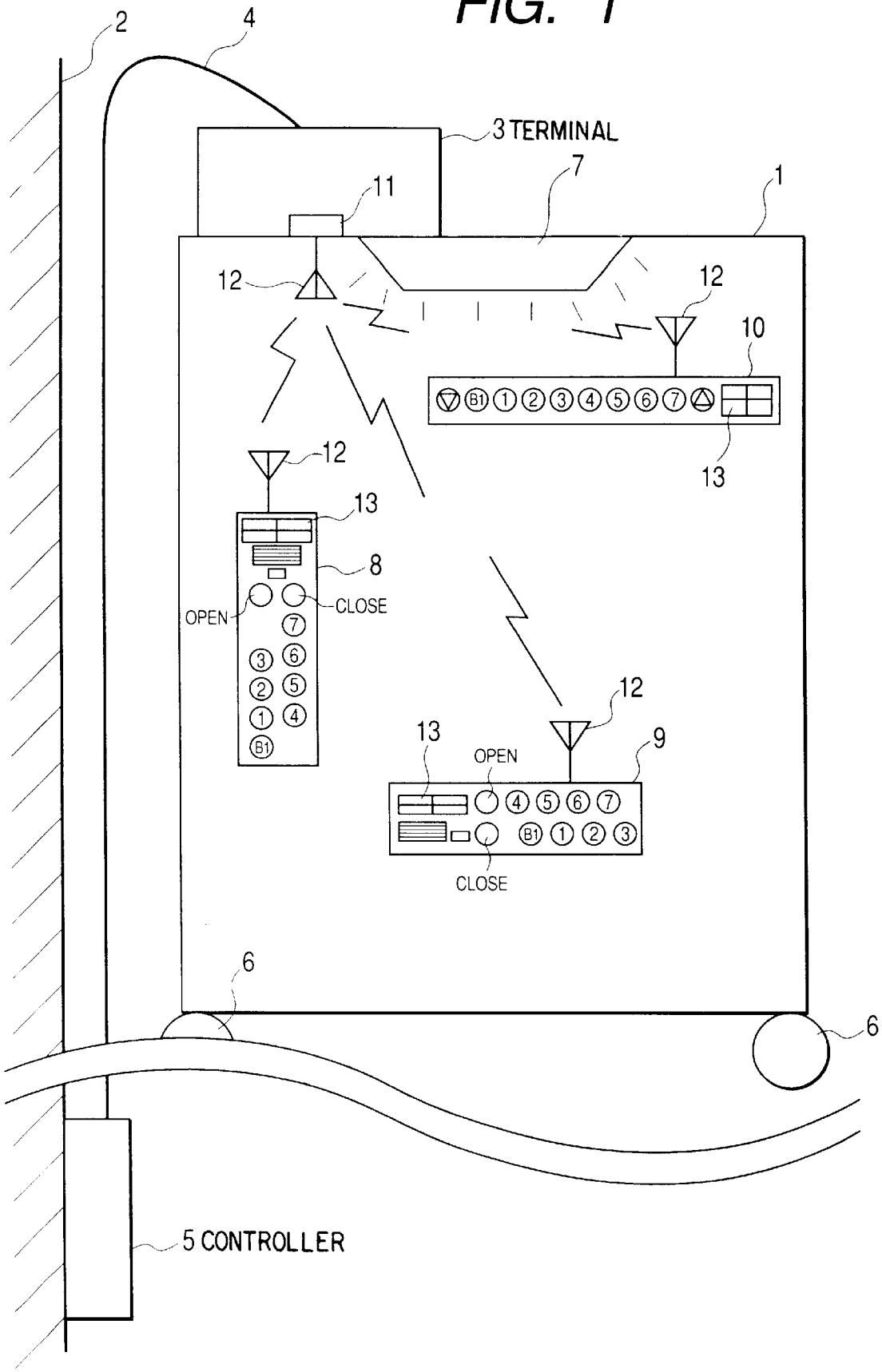
FIG. 1 is a diagram representing the communications apparatus of an elevator as a first embodiment of the present invention.
Figure 2:
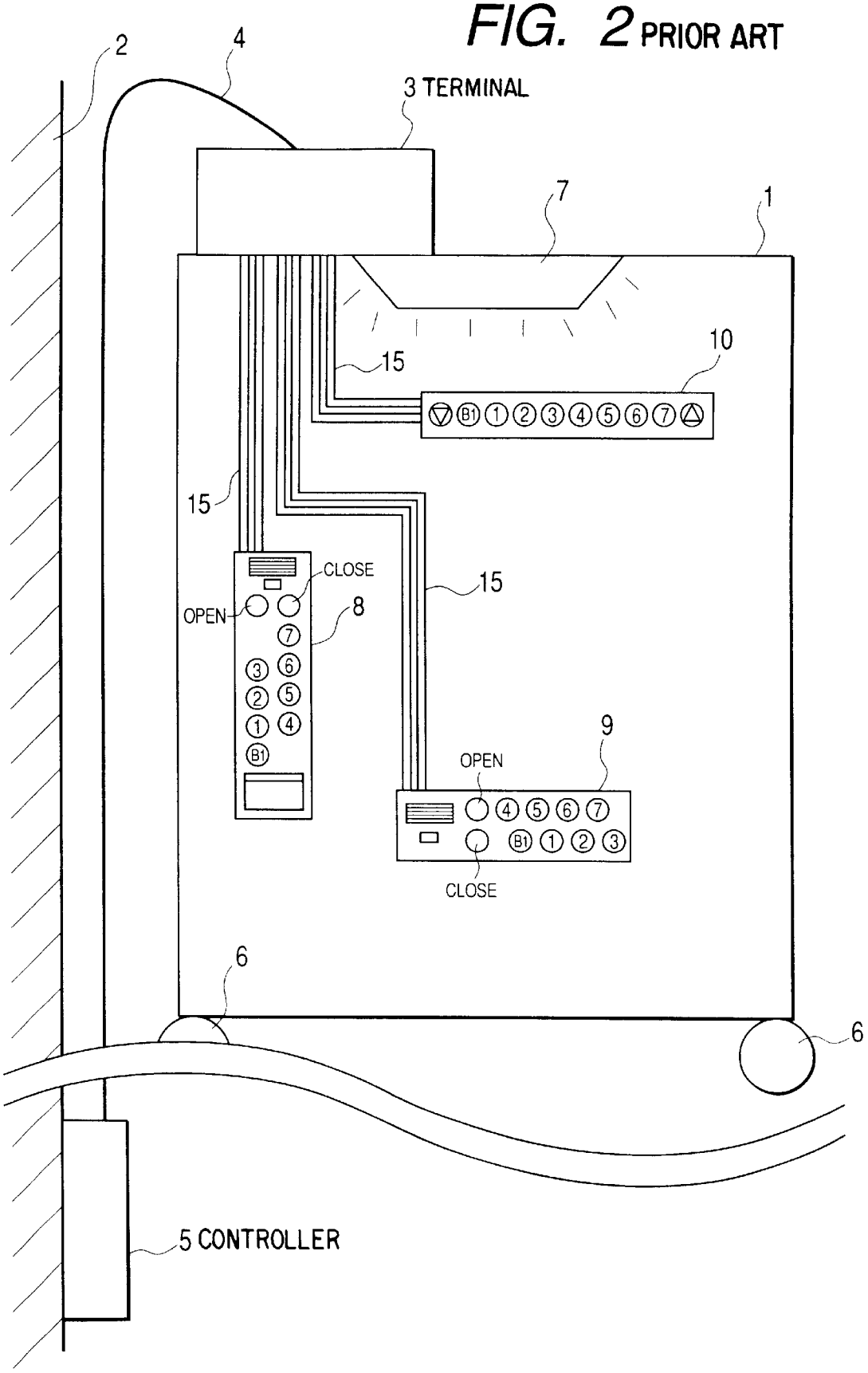
FIG. 2 PRIOR ART
FIG. 2 is a diagram representing the arrangement of an elevator according to the prior art.

The following describes the first embodiment of the present invention with reference to drawings:

FIG. 1 shows the elevator communications apparatus as a first embodiment according to the present invention. In FIG. 1, numeral 11 denotes a radio terminal installed inside the appliance box 3 provided on the upper portion of car 1, and is connected to the elevator controller 5 through the tail code 4. Numeral 12 denotes an antenna connected to each operation panel and the radio communications apparatus inside the radio terminal, and numeral 13 is shows a solar battery. Other numerals are used in the same meaning as those shown in FIG. 2. The position of the radio terminal 11 located in the car 1 can be changed as required.

This embodiment is a system comprising three operation panels 8, 9 and 10 located in the car land one radio terminal 11. Of these three operation panels, two (8 and 9) work as control input units, and 10 works as an indicator. Hereafter the control input unit 8 will be referred to as a control input unit 1, and the control input unit 9 will be referred to as a control input unit 2. As the power source of each operation panel, the light issued by the illuminating light 7 in the car is converted into electric power by the solar battery 13 and is stored into the secondary battery. Signals are exchanged between the operation panel and controller 5 by radio communications between the operation panel and radio terminal 11. communication between the radio terminal 11 and controller 5 is carried out through the tail code 4.

The operation panels 8, 9 and 10 perform radio communications with radio terminal 11 through the radio communications apparatus built in each operation panel and radio communications apparatus built in the radio terminal itself. Signals sent from the operation panel to the radio terminal 11 are sent to the controller 5 by radio through the radio terminal 11; namely, they are sent from the radio terminal 11 through the tail code after passing through the radio terminal 11 or after being subjected to some signal processing or data processing by radio terminal 11. Similarly, signals sent form the controller 5 are further sent to each operation panel through the radio terminal 11. In this way, signals related to communications between each operation panel and radio terminal 11 are exchanged between the radio terminal 11 and controller 5. In other words, communication is carried out between the operation panel and controller 5 through the radio terminal 11.

The operation panels 8, 9 and 10 are installed in a car, and the radio terminal 11 is also mounted in the same car, so each operation panel and radio terminal 11 are located close to each other. Therefore, communication between each operation panel and radio terminal 11 is less affected by external noise. Furthermore, each operation panel and radio terminal 11 are located close to each other, so short range radio transmission such as small power radio transmission can be used for radio communications between them. For example, the frequency band of the radio communications apparatus is 322 MHz or less, and the intensity of electric field 3 meters away from the radio communications apparatus is 500 $\mu$V/m or less. Or the frequency band of said radio communications apparatus is within the range from 322 M to 10 GHz, and intensity of electric field 3 meters away from the radio communications apparatus is 35 $\mu$V/m or less. Or the frequency band of said radio communications apparatus is within the range from 10 G to 150 GHz and intensity of electric field 3 meters away from said radio communications apparatus is 500 $\mu$V/m or less. Or the antenna power of the radio communications apparatus is 10 mW or less.

Figure 3A:
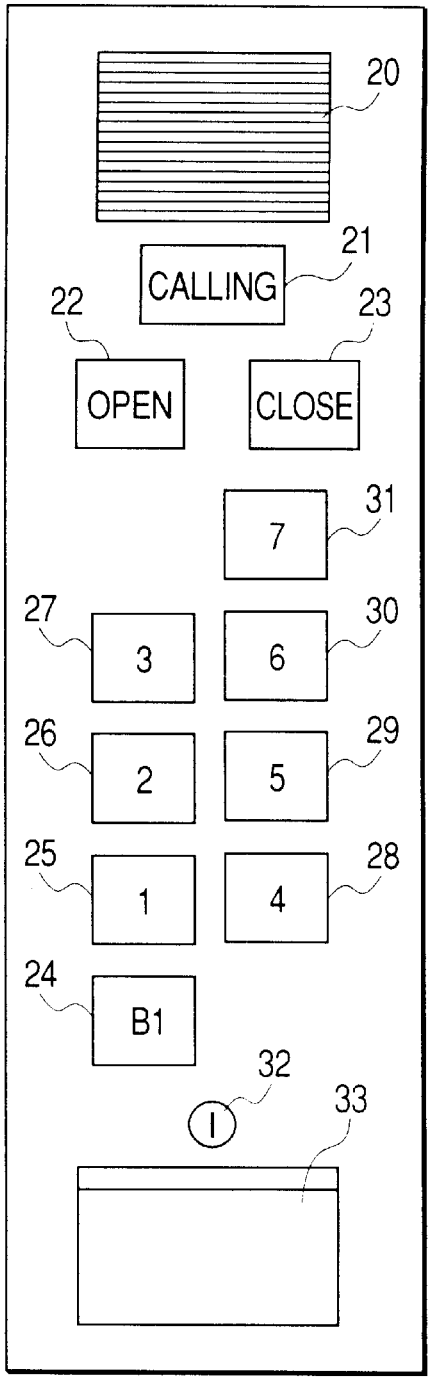
FIG. 3(a) PRIOR ART
FIG. 3 is a diagram representing the external structure of a control input unit according to the prior art.
Figure 3B:
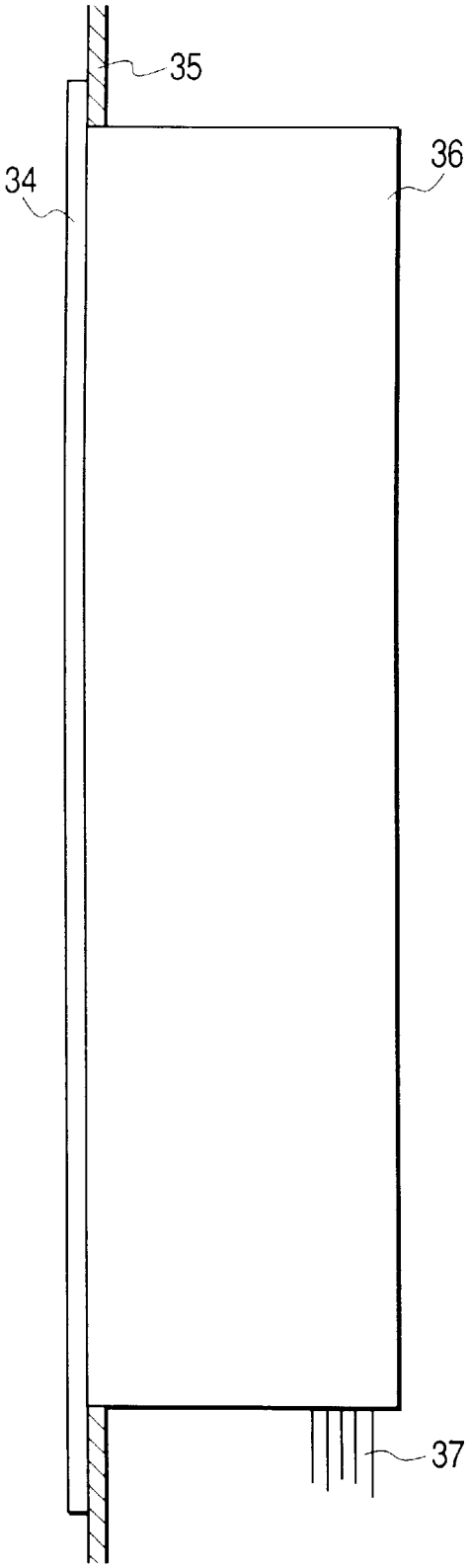
FIG. 3(b) PRIOR ART
Figure 5A:
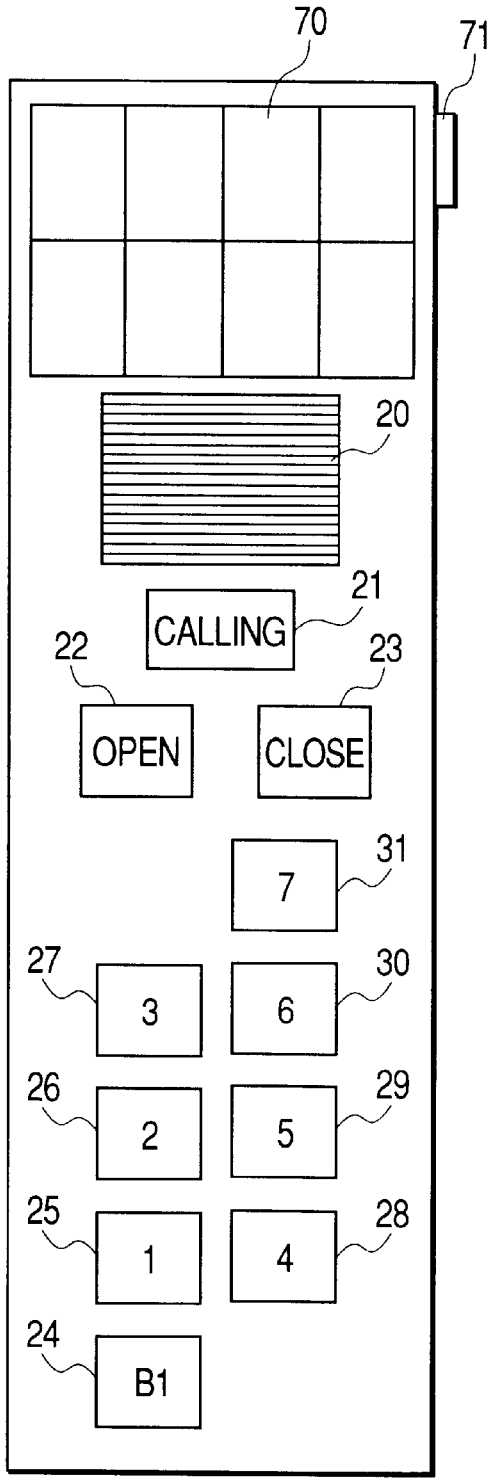
FIG. 5 is a diagram representing the external structure of a control input unit as a first embodiment of the invention.
Figure 5B:
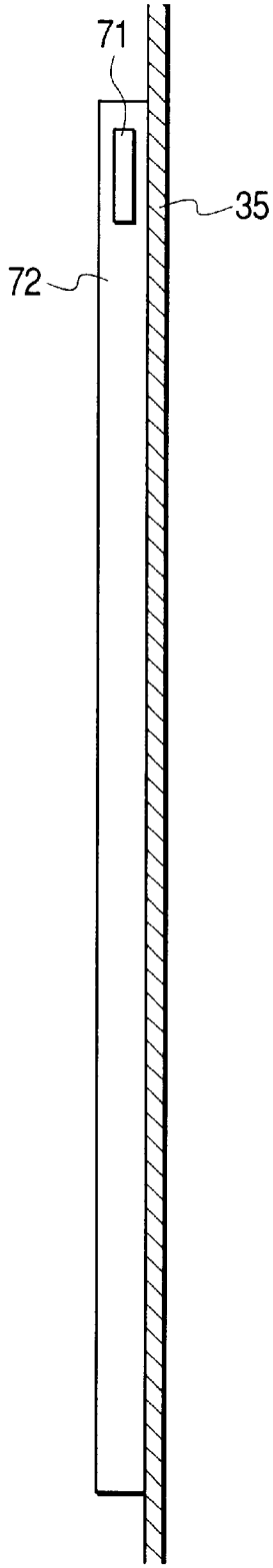

The following describes the control input unit and indicator with reference to drawings:

FIG. 5 is external view representing the control input unit in the present embodiment, where (a) is a front view, and (b) is a side view. In FIG. 5, numeral 70 denotes a solar battery, 71 a transmitter/receiver antenna of the built-in radio communications apparatus, 72 a control input unit proper, 35 a car wall. Other numerals are used in the same meaning as those in FIG. 3.

Figure 4A:
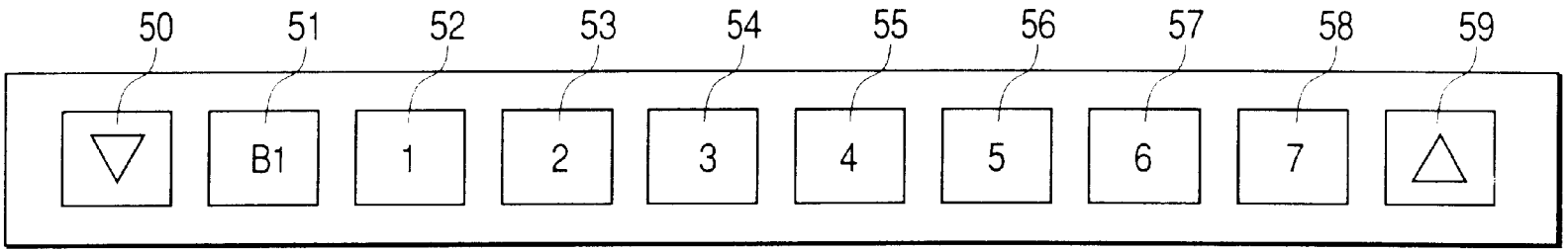
FIG. 4(a) PRIOR ART
FIG. 4 is a diagram representing the external structure of an indicator according to the prior art.
Figure 4B:
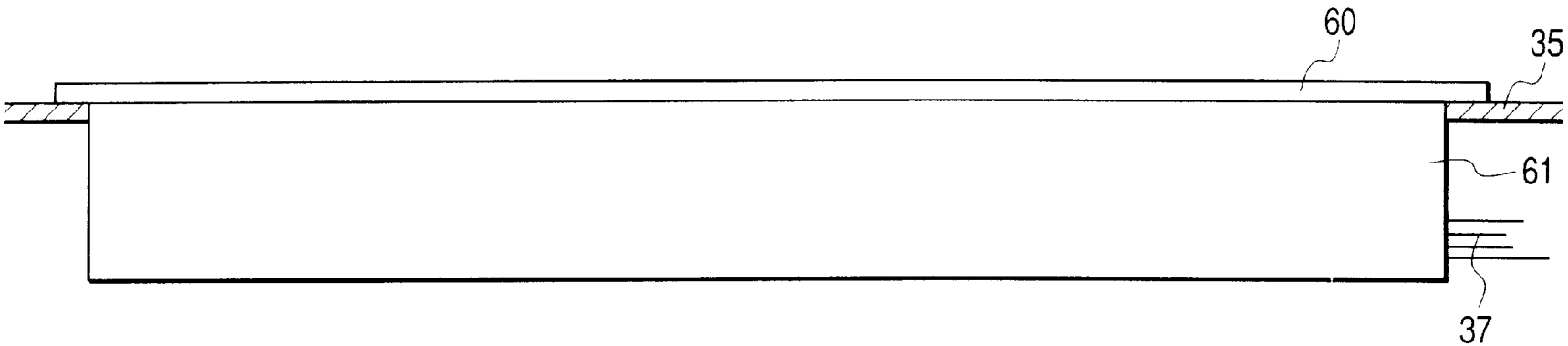
FIG. 4(b) PRIOR ART
Figure 6A:
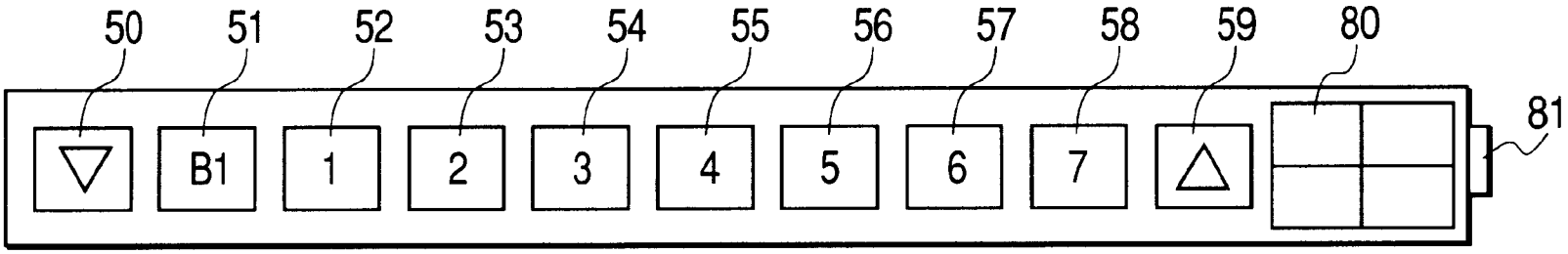
FIG. 6 is a diagram representing the external structure of an indicator as a first embodiment of the invention.
Figure 6B:
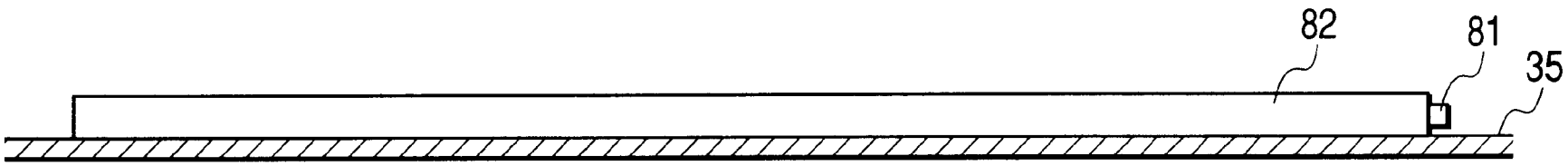

FIG. 6 is a external view representing an indicator in the present embodiment, where (a) is a front view, and (b) is a side view. In FIG. 6, numeral 80 denotes a solar battery, 81 a transmitter/receiver antenna of the built-in radio communications apparatus, 82 an indicator proper, and 35 a car wall. Other numerals are used in the same meaning as those in FIG. 4. By eliminating use of wires for communication and electric power, hence, by eliminating wires to be led from the operation panel, the present embodiment allows the operation panel to be mounted on the car wall surface in a non-embedded manner. In other words, the operation panel can be mounted on the car wall surface without deteriorating the external view, as shown in FIGS. 5 and 6. Furthermore, the operation panel can be mounted removably on the car wall surface by installing a magnet or suction cup on the back of the operation panel, namely, on the surface facing the car wall surface.

Figure 7:
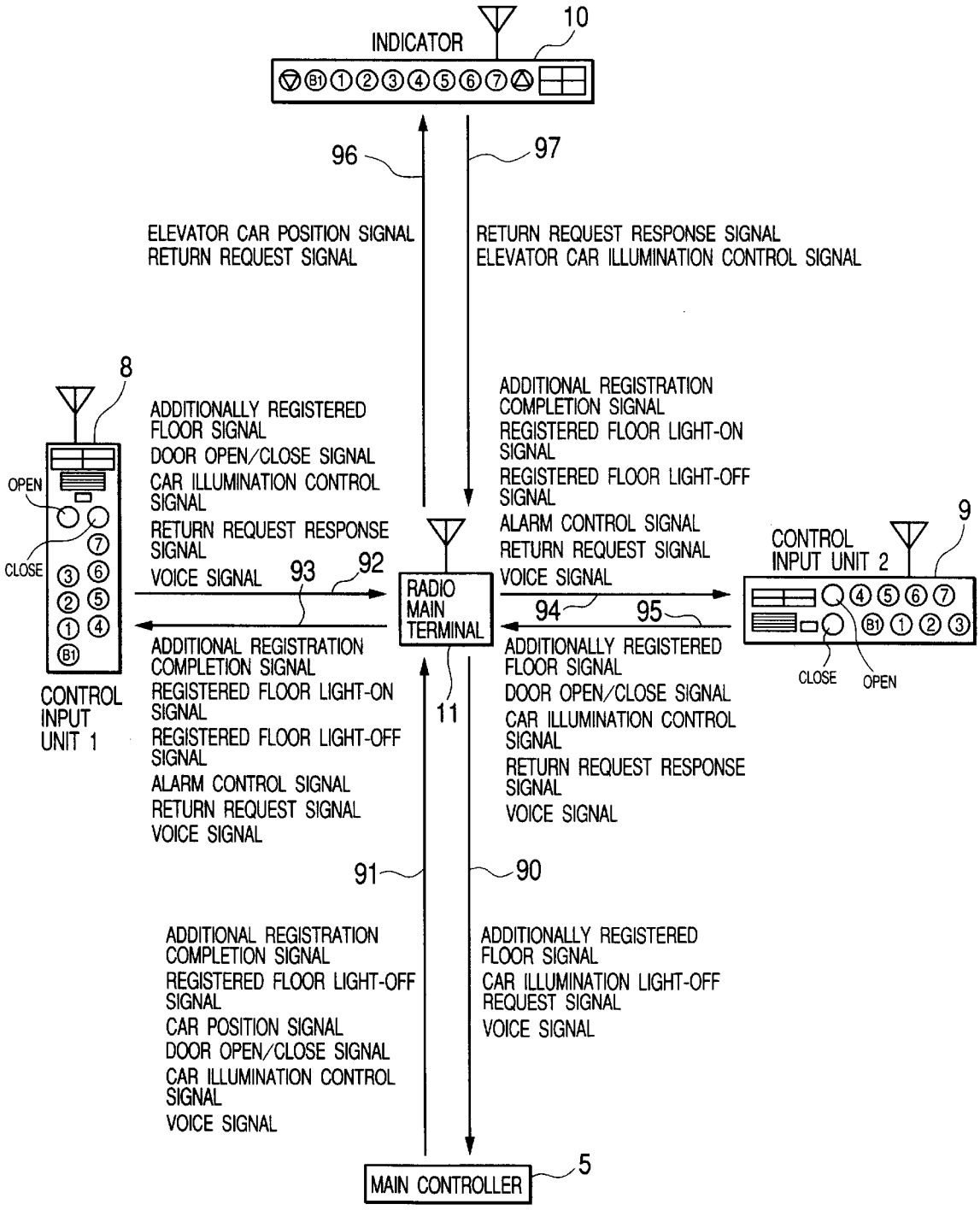
FIG. 7 is a diagram illustrating the details of communications in the first embodiment of the invention.

The following describes the overview of communication among each operation panel, radio terminal and controller with reference to FIG. 7:

In FIG. 7, numeral 5 denotes a controller, 8 a control input unit 1, 9 a control input unit 2, 10 an indicator and 11 a radio terminal.

Numeral 90 indicates signals from the radio terminal 11 to the controller 5. They include an additionally registered floor signal, car light-off request signal and voice signal. As will be described later,the additionally registered floor signal is issued when the destination floor registration button of the control input unit has been pressed. In this way, signals are sent to controller 5 through the radio terminal 11. The voice signal indicates conversation exchanged between the maintenance personnel and passengers when the maintenance personnel calling button is pressed.

Numeral 91 indicates the signals sent from the controller 5 to the radio terminal 11. They include additional registration completion signal, registered floor light-off signal, car position signal, door opening/closing signal, car illumination control signal and voice signal The additional registration completion signal is used to inform the radio terminal 11 that the aforementioned additionally registered floor signal has been received by the controller 5. The registered floor light-off signal is a signal to specify turning off of the registered floor response light, for example, when the car has reached the registered floor. The car position signal is a signal sent to the indicator 10 through radio terminal 11 in order to inform the indicator of the current car position.

Numeral 92 denotes a signal sent from the control input unit 1 to the radio terminal 11, and includes the additionally registered floor signal, door opening/closing signal, car illumination control signal, return request response signal and voice signal. As will be described later, the car illumination control signal is a signal to request the radio terminal 11 to turn on the illuminating light in the car to ensure that the solar battery produces electromotive force to charge the secondary battery, when the remaining power of the secondary battery of the control input unit 1 has reduced below the specified value. It also requests the light to be turned off when charging has completed. As will also be described in detail later, the return request response signal is a response signal for the return request signal issued from the radio terminal 11 to the control input unit 1.

Numeral 93 denotes a signal sent from the radio terminal 11 to the control input unit 1. It includes a additional registration completion signal, registered floor light-in signal, registered floor light-off signal, alarm control signal, return request signal and voice signal. The registered floor light-on signal is a signal to report the new registered floor to the control input unit other than the source of sending the additionally registered floor signal, when the radio terminal 11 has received the additional registration completion signal from the controller 5. The alarm suppression signal is a signal to suppress the sounding of an alarm buzzer built in the control input unit. When the control input unit is brought out of the car by someone, the operation panel as a control input unit issues an alarm, according to this arrangement. Normally, the control input unit receives the alarm suppression signal, so alarm is not produced. The return request signal is a signal issued to verify if communication between the radio terminal 11 and control input unit 1 is carried out correctly or not. The control input unit 1 having received it is to issue signals to the radio terminal 11 which is a source of the return request response signal. If the return request response signal cannot be received after the lapse of a specified time, a communications error or failure of the radio communications apparatus built in the radio terminal 11 may have occurred.

Numeral 94 is a signal sent from the radio terminal 11 to the control input unit 2. The details of the signal are the same as those of numeral 93.

Numeral 95 is a signal sent from the control input unit 2 to the radio terminal 11. The details of the signal are the same as those of numeral 92. of the signals described above, signals 92 to 97 are transmitted by radio and signals 90 and 91 are sent in wired communications by the tail code in the present embodiment. However, communication by the tail code may be performed by radio. Furthermore, the number of the control input units and indicators can be increased.

Figure 8:
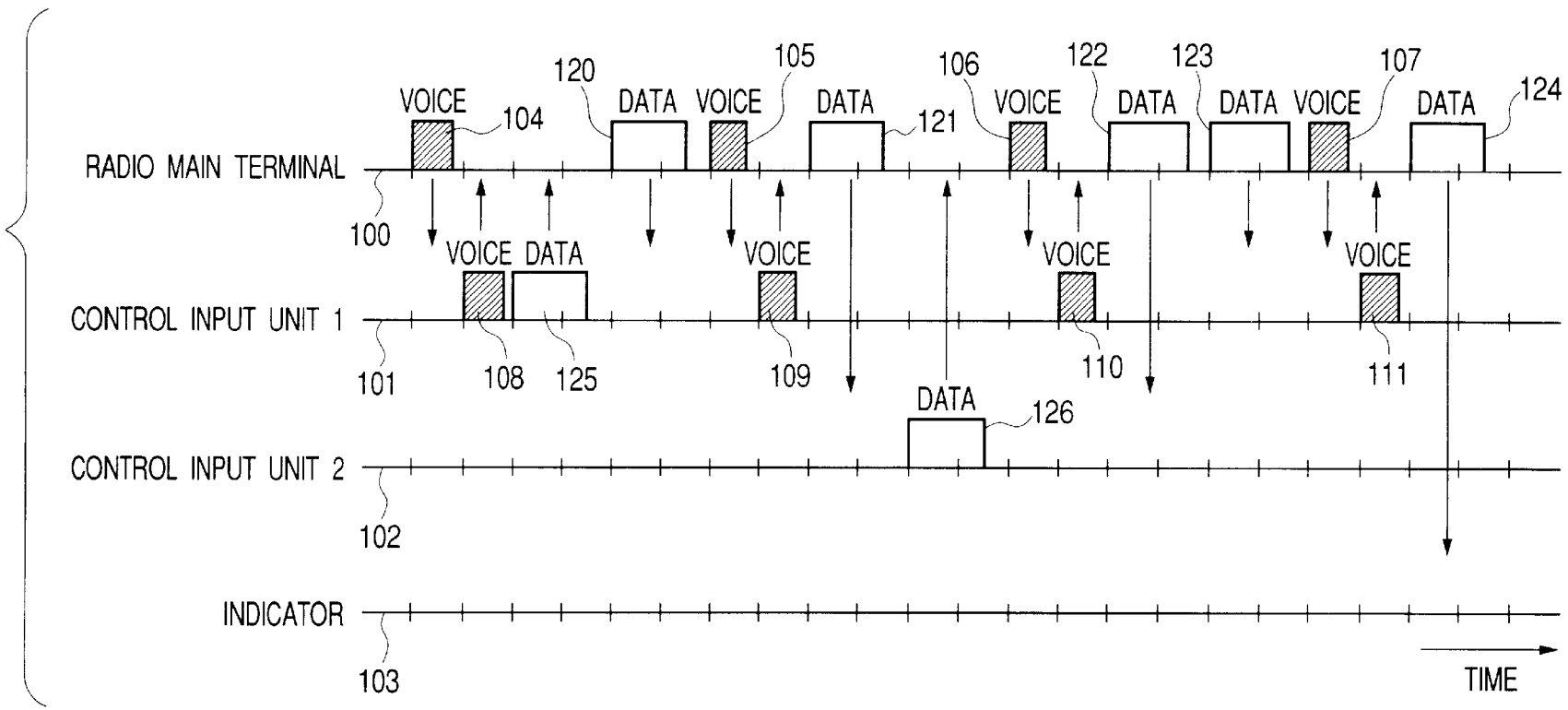
FIG. 8 is a diagram illustrating the method of communications in the first embodiment of the invention.

The following describes the method for communication carried out by the radio terminal, control input unit 1, control input unit 2 and indicator with reference to FIG. 8: In FIG. 8, numeral 100 denotes a time axis of radio terminal, 101 a time axis of control input unit 1, 102 a time axis of control input unit 2 and 103 a time axis of indicator. Numerals 104 to 111 indicate voice data. The positions in FIG. 8 indicate the transmission source of the voice data and time of transmission. The width shows the time required for transmission. Numerals 120 to 126 show non-voice data. Similarly to the case of voice data, the positions indicate the transmission source of the voice data and time of transmission. The width shows the time required for transmission. The destination of voice data and non-voice data is located on the time axis indicated by the arrow mark. In this way, each radio communications apparatus exchanges data by swift switching between transmission and reception. Furthermore, each data is headed by a destination, so other than signals addressed to itself can be ignored. With respect to transmission timing, to prevent conversation from becoming discontinuous in the case of voice data in particular, the A/D converted data is formed into a small packet and is sent at almost a specified time interval.

Figure 9:
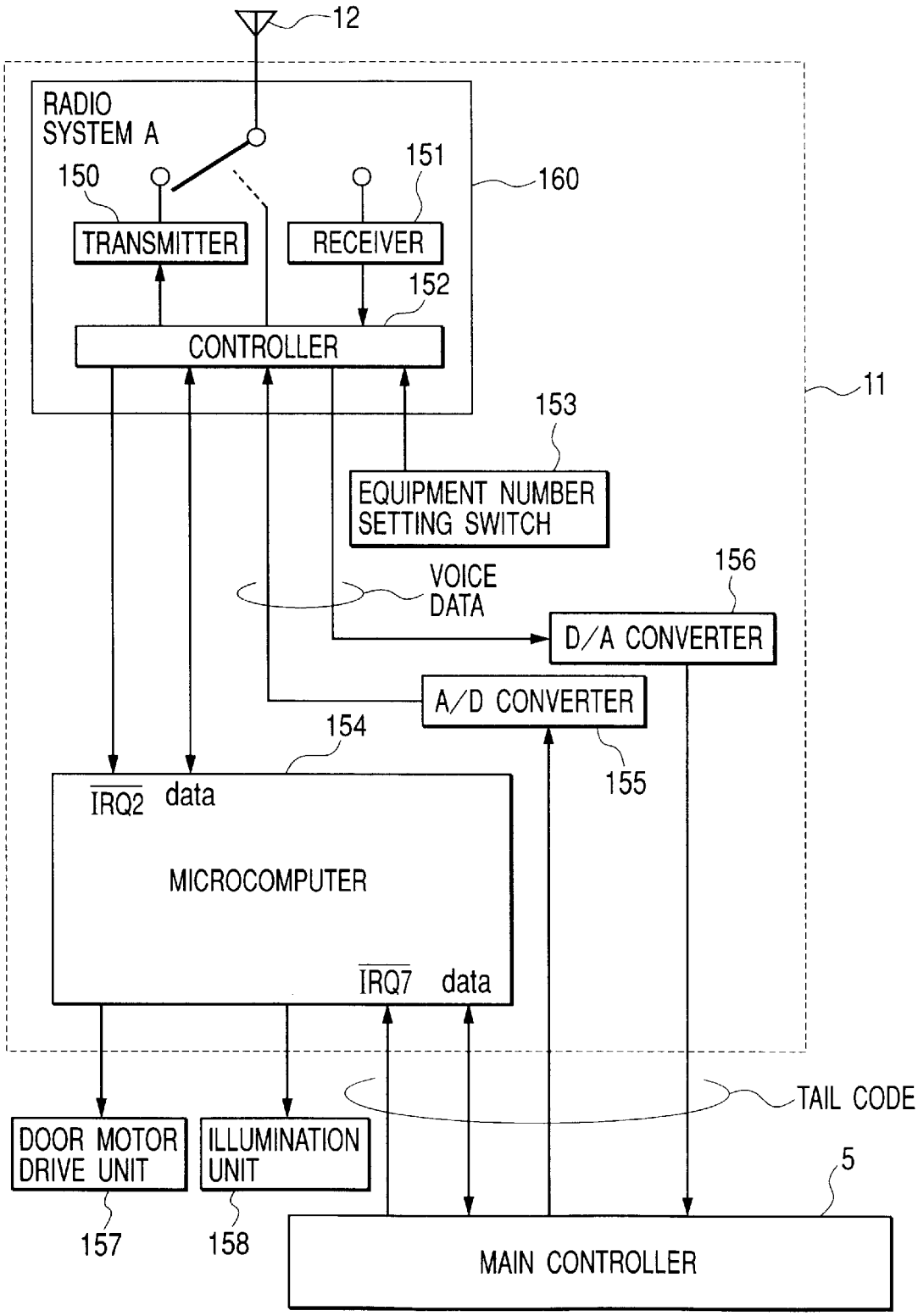
FIG. 9 shows the internal structure of a radio terminal in the first embodiment of the invention.

The following describes the internal arrangement of the radio terminal, control input unit and indicator to realize the aforementioned functions:

FIG. 9 shows an internal arrangement of the radio terminal 11. In FIG. 9, the area inside the broken line shows the radio terminal 11. Numeral 160 denotes a radio communications apparatus, 12 an antenna, 150 a transmitter in the radio communications apparatus, 151 a receiver in the radio communications apparatus, and 152 a controller for overall control of the radio communications apparatus. Numeral 153 indicates an equipment number setting switch. The value set by this switch indicates the destination for the data transmission. Numeral 155 is an A/D converter, which converts the analog signal sent from the controller 5 through the tail code into digital signal, which is input into the radio communications apparatus 160. Numeral 156 is a D/A converter. The digital signal sent from the radio communications apparatus 160 is converted into the analog signal, and is transmitted to the controller 5. Numeral 157 indicates a door drive motor and 158 a illumination unit in the car. Numeral 154 represents a microcomputer connected to the radio communications apparatus 160, controller 5, illumination unit 157 and illumination unit 158 to take charge of communications and control with them. In this arrangement, when the radio communications apparatus 160 has received data, it sends IRQ2 interrupt request to the microcomputer 154. Upon receipt of IRQ2, the microcomputer 154 starts receiving of data from the radio communications apparatus 160. Further, when the controller 5 sends data to the radio terminal 11, sends IRQ7 interrupt to the microcomputer 154.

Upon receipt of IRQ7, the microcomputer 154 starts receiving of data from the controller.

Figure 10:
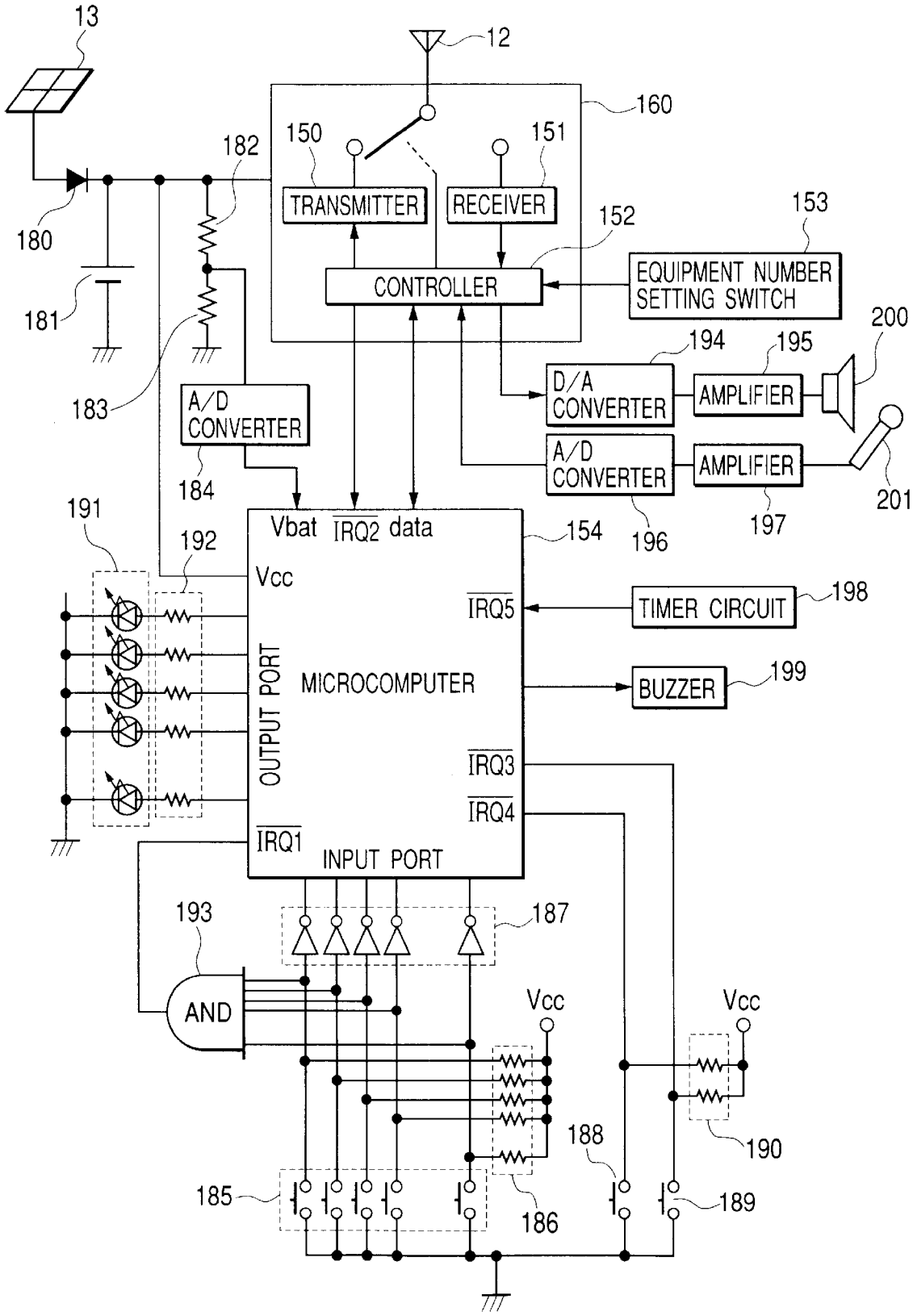
FIG. 10 shows the internal structure of a control input unit in the first embodiment of the invention.
Figure 23A:
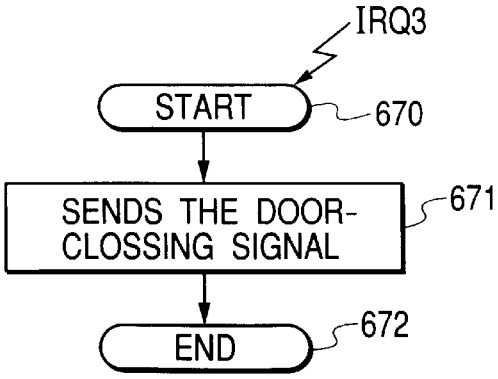
FIG. 23 shows the procedure for transmitting door opening/closing signals.
Figure 23B:
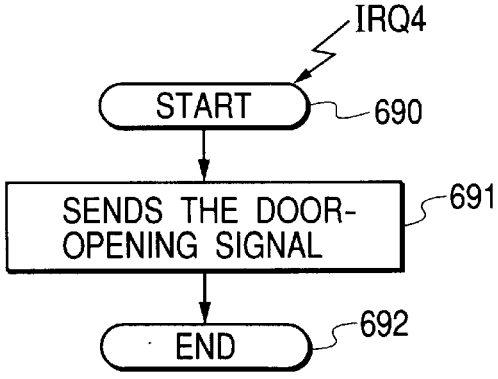

FIG. 10 shows the arrangement inside the control input unit. In FIG. 10, numeral 13 denotes a solar battery for generating power in response to car illumination, 181 shows a secondary battery for storing the power generated by the battery 13, 180 denotes a back flow preventive diode for preventing power of the secondary battery 181 from flowing backward to the solar battery 13, 182 and 183 indicate voltage dividing resistors for dividing the voltage of the secondary battery 181, 184 shows an A/D converter for conversion of the voltage divided by voltage dividing resistors 182 and 183 into the digital signal which is input into the microcomputer 154 as VBAT, 194 denotes a D/A converter to convert the digital voice signal received by the radio communications apparatus 160 into the analog signal, and 195 shows an amplifier for amplifying the output of the D/A converter 194 and driving the speaker 200, 197 denotes an amplifier for multiplying the output signal from the microphone 201, 196 denotes an A/D converter for converting the analog signal of the amplifier 197 into the digital signal and sending it to the radio communications apparatus 160, 198 denotes a timer circuit for requesting the microcomputer 154 to send the interrupt signal IRQ5 at a certain interval (e.g. one sec.), 199 denotes a buzzer driven by the microcomputer 154, 185 a destination floor registration button, and 186 and 190 denote pull-up resistors. Numeral 187 denotes a NOT circuit, 193 an AND circuit, 191 a destination floor response light, 192 a current limiting resistor, 188 a door-opening request button, and 189 a door-closing request button. Other codes and functions are used in the same meaning as those in FIG. 9. The following describes the briefly describes the circuit operation of FIG. 10. If any one of destination floor registration buttons 185 is pressed, the output of the AND circuit 193 connected to the IRQ1 request input terminal is changed from HIGH to LOW. The microcomputer 154 is programmed in advance in such a way that, when the IRQ1 request input terminal changes from HIGH to LOW, it receives the IRQ1 interrupt. The microcomputer is also programmed in such a way that, upon receipt of IRQ1 interrupt, it detects the port input connected to the output from the NOT circuit 187. This allows the input port to be detected only when the destination floor registration button is pressed. The switches for the input port and destination floor registration button 185 each are connected at a one-one ratio through the NOT circuit. When the button is pressed, the bit of the corresponding input port is set to "1". For the output port, in the meantime, each indicator light of the destination floor response light is connected to the output port at a one-one ratio through the current limiting resistor 192, and the indicator light is turned on when the corresponding bit of the output port is set to "1". Further, by pressing the door-opening request button 188, the microcomputer is requested to send the IRQ4 interrupt signal alone. Upon receipt of the IRQ4 interrupt signal alone, the microcomputer is so programmed send the door-opening signal to the radio terminal. The door-closing request button is also configured in the similar way. This processing is shown in FIG. 23(*a*) and FIG. 23(*b*). Many interrupt factors are present to such a microcomputer 154. Safety is ensured and the alarm reset key (to be described later) can be input by setting the IRQ4 to the top priority.

Figure 11:
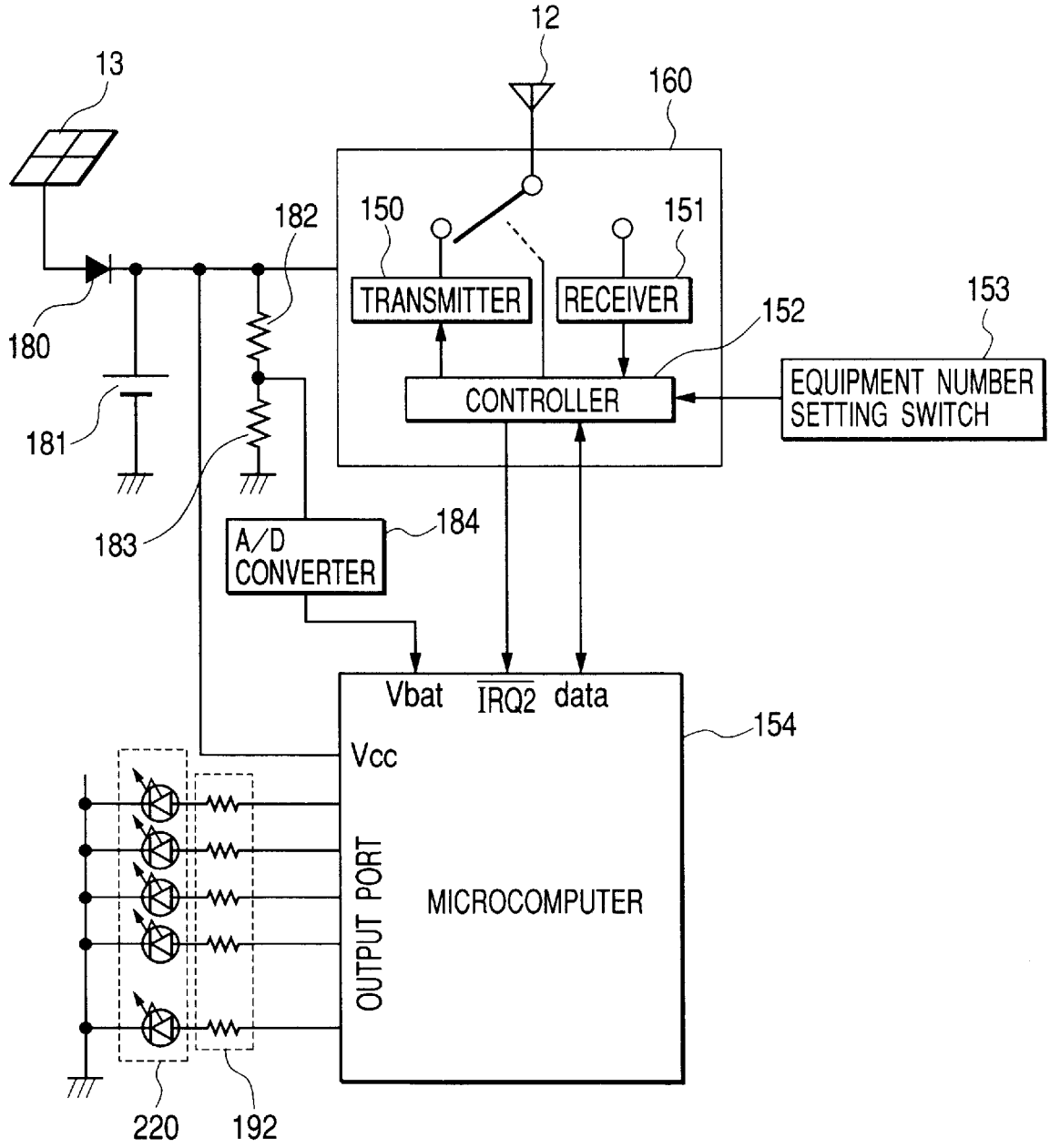
FIG. 11 shows the internal structure of an indicator in the first embodiment of the invention.
Figure 12:
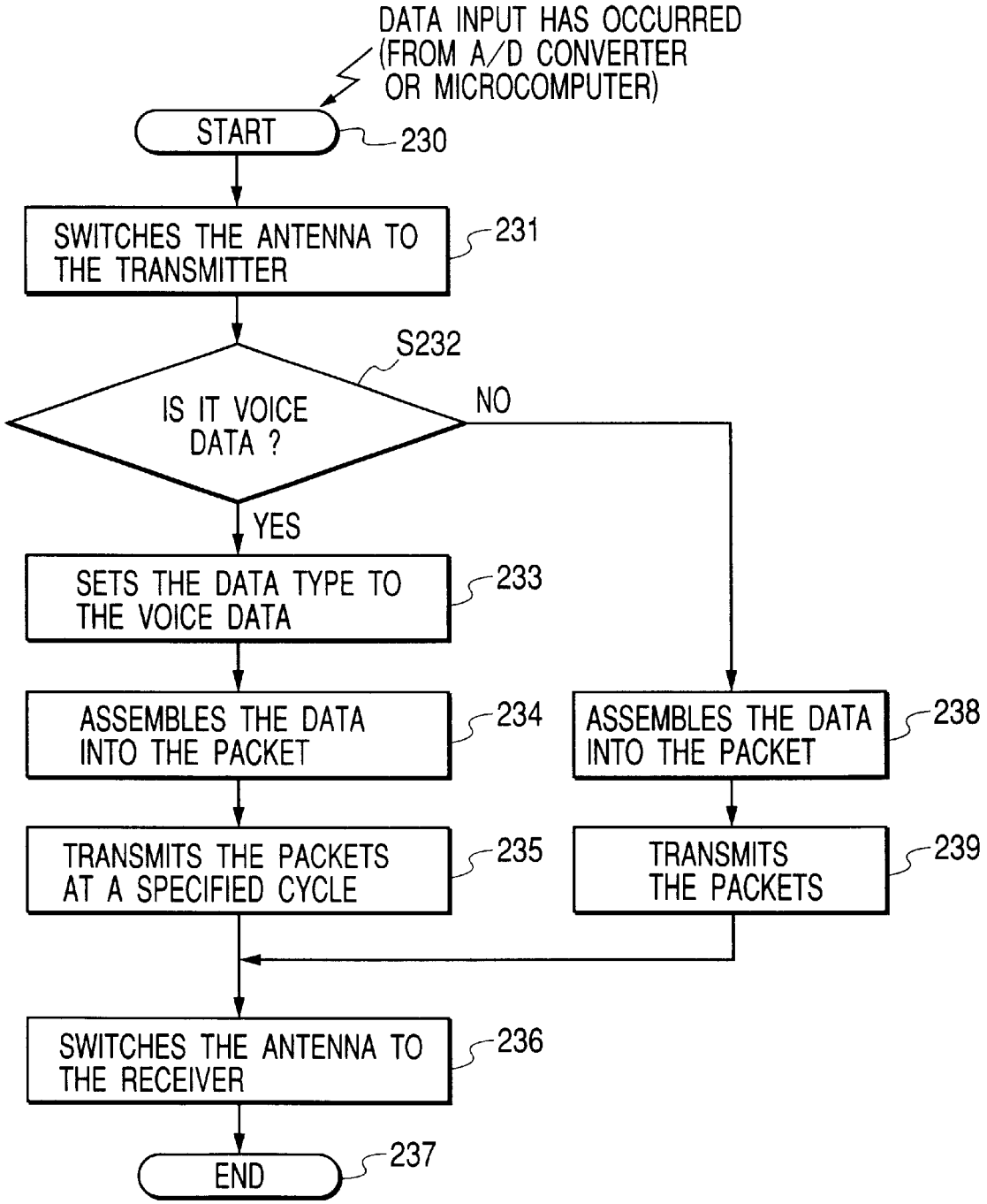
FIG. 12 is a flowchart illustrating the transmission procedure of a controller; 3

FIG. 11 shows the arrangement inside the indicator. In FIG. 11, 220 denotes a car position indicator light, and other codes and functions are used in the same meaning as those in FIGS. 9 and 10. The following describes the operation of the controller 152 of the radio communications apparatus 160 mounted on each operation panel, with reference to the case where it is mounted on the control input unit given in FIG. 10. Firstly, the case of the first transmission will be explained. Then the case of reception will be described. FIG. 12 is flow chart showing the transmission procedure of the controller 152. Firstly, when the output signal of the microcomputer 154 or A/D converter is input to the controller 152, the antenna is switched to the transmitter side. Then in Step 232, evaluation is made to see whether the data is a voice data or not. If it is voice data, the system goes to proceed to Step 233, and data type is formed in to a packet as a voice data. Then it is sent at a specified interval, as shown in FIG. 8. When the data is not voice data according to evaluation in Step 232, it is assembled into a packet, and is normally transmitted, as shown in FIG. 8. After completion of transmission, the antenna is switched to the receiver side, and the system wait for the next command in the state of reception.

Figure 13:
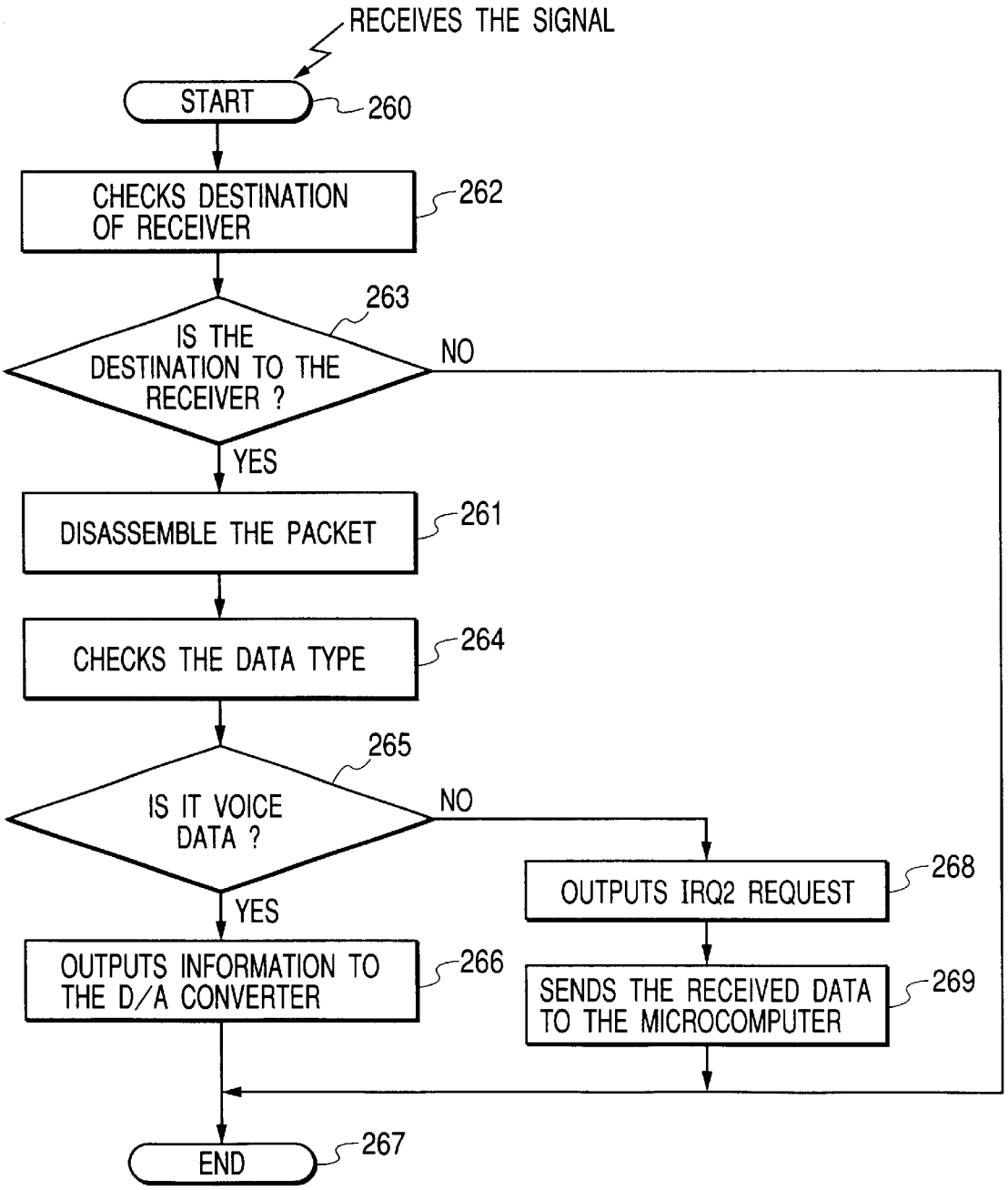
FIG. 13 shows processing to be performed when receiving signals.

The following describes the processing at the time of reception with reference to FIG. 13. When the receiver 151 has received the signal, it checks the destination in Step 263 to see if it is addressed to itself. If so, the packet is disassembled in Step 261, and checks the data type. Evaluation is made in Step 265 to see if the data is the voice data or not. If so, the information is output to the D/A converter, and processing is now complete. If it is not addressed to itself according to evaluation in Step 263, processing terminates. If the data is not voice data according to evaluation in Step 265, IRQ2 request signal is output to the microcomputer 154 and the data is sent to the microcomputer 154. Then processing terminates.

Figure 14:
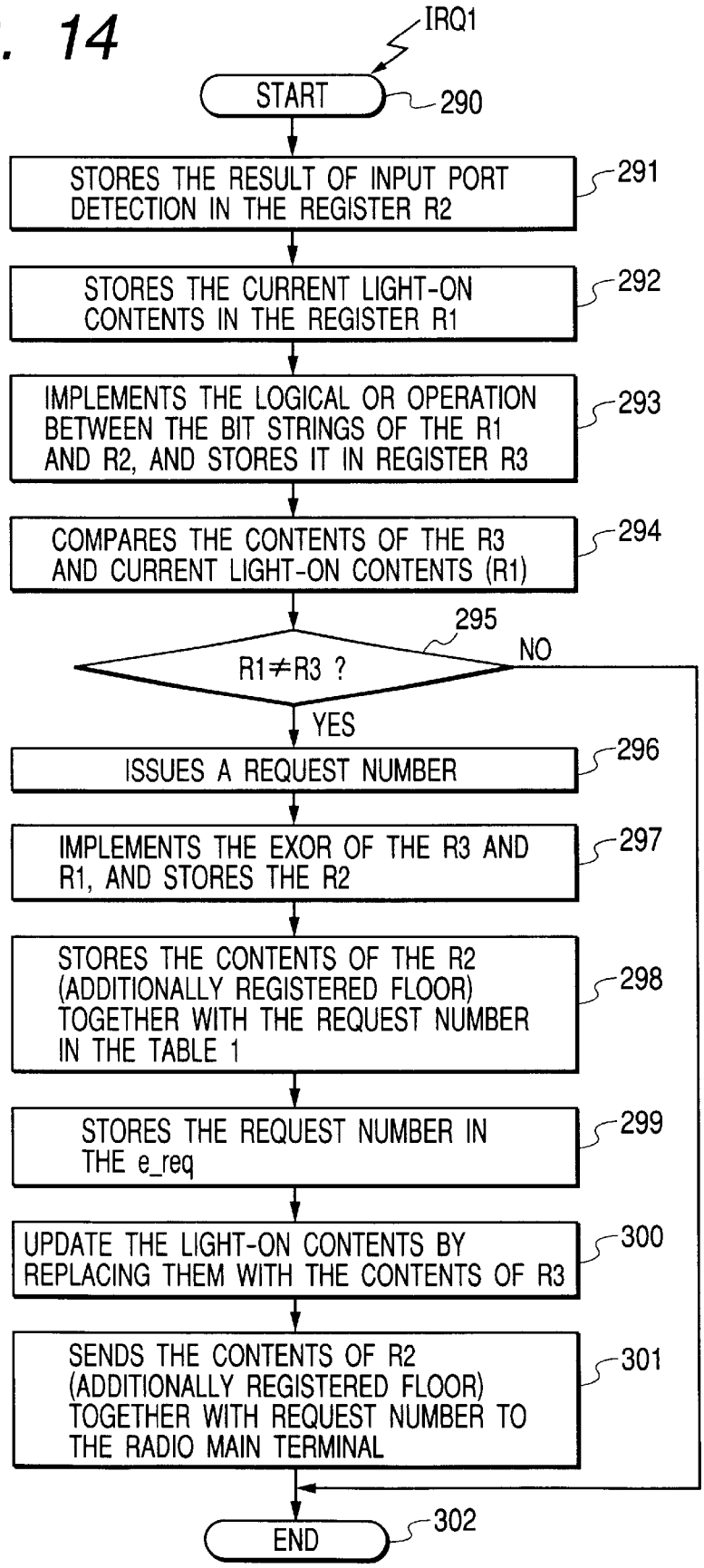
FIG. 14 shows processing to be performed in the microcomputer when a destination floor registration button is pressed.

With reference to FIG. 14, the following describes the steps of processing inside the microcomputer when the destination floor registration button is pressed for the control input unit in FIG. 10. If any one of destination floor registration buttons 185 has been pressed, IRQ1 interrupt request signal is issued as described above. Upon receipt of the interrupt request signal, the processing goes to Step 291, the detection result of the input port is stored in register R2. In this case, the state of each bit in the register R2 has a one-to-one relationship with the destination floor registration button. When the corresponding bit is "1", it shows that the button has been pressed. The current light-on state is stored in the register R1 in Step 292. This can be realized when the contents of the register retaining the state of the output port is sent to the R1. In Step 293, the logical OR operation of bit strings between the register R1 and R2 is implemented, and the result is stored in register R3.

Figure 15:
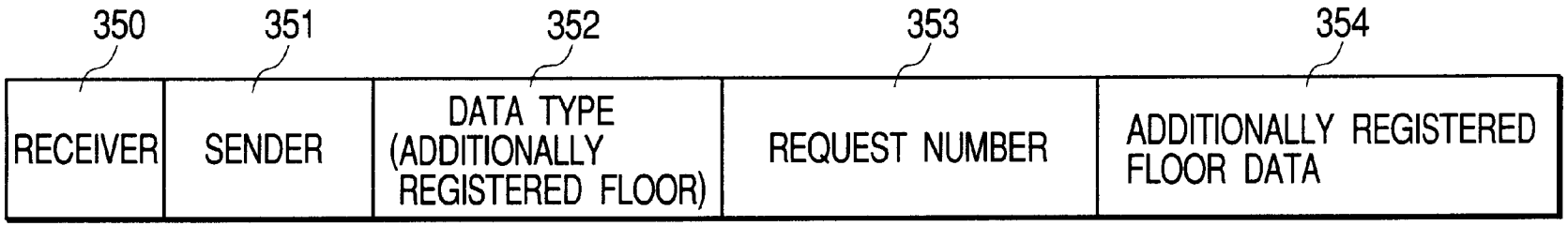
FIG. 15 illustrates the format for additionally registered floor signals.

As a result, new destination floor registration information in addition to the current destination floor registration information is recorded in the register R3. Then in Step 295, evaluation is made to see if the contents of the R1 are different from those of the R3 or not. That they are different means that the destination floor registration button other than the ones for already registered destination floors has been pressed. If they are not different according to evaluation in Step 295, the processing goes to Step 302, and processing is now complete. If they are found to be different in Step 295, processing goes to Step 296, and the request number is issued. This request number can be represented by 8 bits ganging from 0 to 255. One is added for every issue. After it has reached 255, it goes back to 0. This process is repeated thereafter. The request number is used to cancel the result of processing in Step 300 (to be described later) when there is no additional registration completion signal from the controller. Then in Step 297, the logical XOR (exclusive logical sum) operation of the bit strings between the register R3 and register R1 is implemented, and the result is stored in the register R2. As a result of this computation, only the bit corresponding to the new destination registered floor is "1" and remains in the register R2. The bit corresponding to the already registered floor becomes "0". Then in Step 298, the contents of register R2 together with the request number issued in Step 296 are stored in the Table 1 of the format shown in FIG. 17. In FIG. 17, when this elevator system is assumed to be installed in a building from 81st floor to the 7th floor, for example, the additionally registered floor with the request number 0 in Table 1 will be the 3rd floor when the bit on the rightmost position corresponds to basement 1. Then in Step 299, the request number is stored in variable e_req. This operation allows a very recently issued request number to be stored in the variable e_req. Then in Step 300, light-on data is replaced with the contents of register R3. This allows the destination floor indicating response light to be replaced by the response light corresponding to the newly pressed destination floor registration button added to the current destination floor response. Then in Step 301, the contents of the register R2 together with the request number are sent to the radio terminal. This allows the newly occurring registered floor information and request number to be sent to the radio terminal. FIG. 15 shows the data format for the additionally registered floor signal to be sent in this case. In FIG. 15, numeral 350 denotes a destination for transmission (Receiver), 351 a source of transmission (Sender), 352 a data type (additionally registered floor, 353 a request number and 354 an additionally registered floor data.

FIG. 16 shows processing started in response to the IRQ5 interrupt request signal issued at 1-second intervals by the timer circuit 198 of FIG. 10. It shows the processing of turning off the destination floor response light for the additionally registered floor signal where the additional registration completion signal cannot be obtained after the lapse of 1 second or more. Upon receipt of the IRQ5 interrupt signal, timer interrupt number t_num is read from the memory in Step 381. This timer interrupt number t_num is represented by two bits from 0 to 3. As will described later, 0 comes back after 3 for each interrupt of the IRQ5. This is repeated thereafter. The timer interrupt number is updated in Steps 382, 384 and 385. Then in Step 386, the most updated request number is taken out of the aforementioned variable e_req, and is stored together with the t_num as L_req in the Table 2.

FIG. 18 shows the format of Table 2. In Steps 387 to 393. Based on the current timer interrupt number t_num, the request number most updated at the time of IRQ 5 interrupt 2 seconds before and the request number most updated at the time of IRQ 5 interrupt one second before are taken out by making reference to Table 2. Then in Step 394, the logical OR operation of the bit strings of the additionally registered floor data having occurred between two request numbers taken out in Steps 387 to 393 is implemented by making reference to Table 1. The result of computation is stored in the register R4. Then in Step 395, the logical NOT operation of the bit string between the register R4 is implemented, and the result is again stored in the register R4. Then in Step 396, the logical AND operation of the bit strings between the contents of the register R4 and current light-on contents is implemented, and the result is used to update the indicator.

Figure 20:
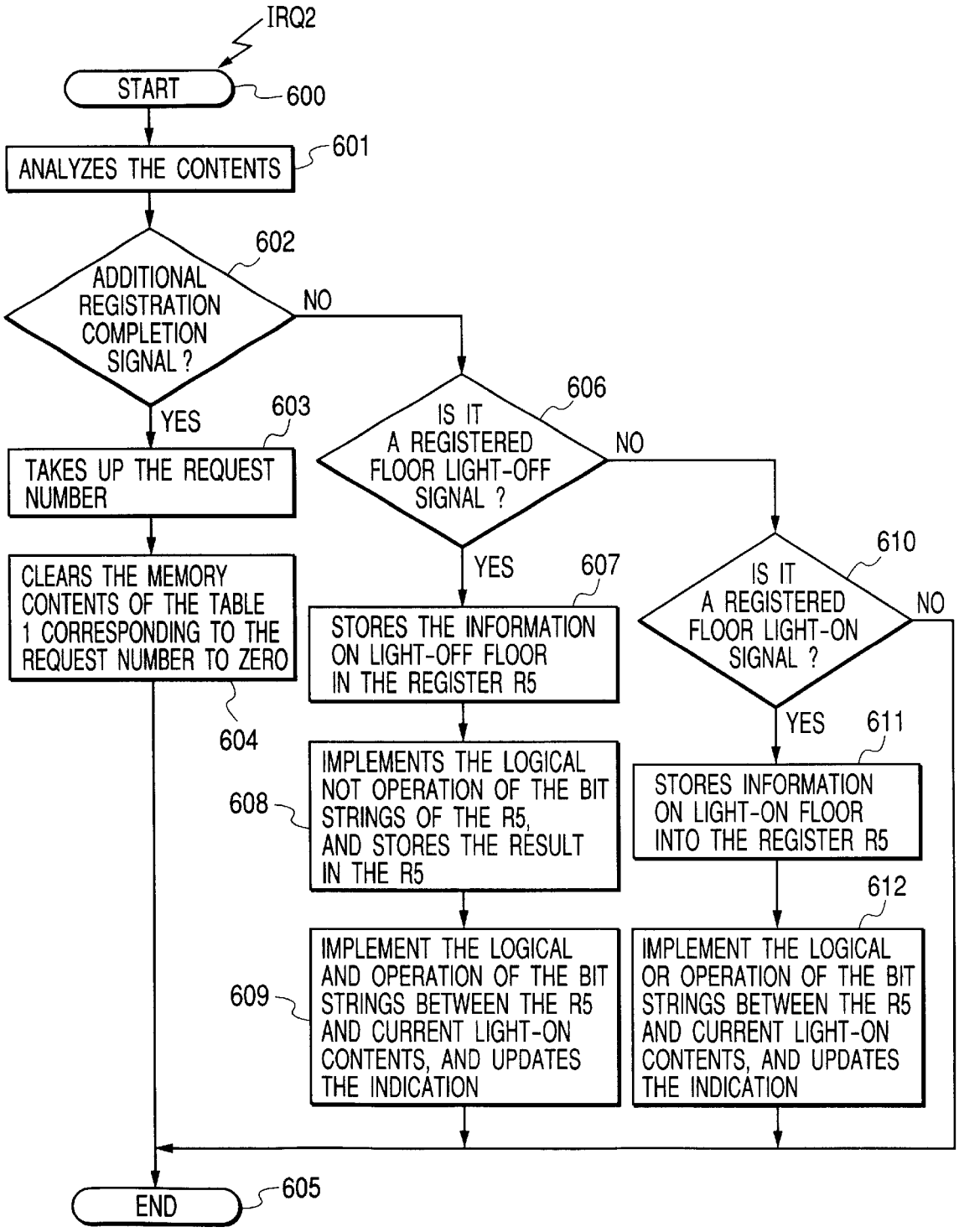
FIG. 20 shows processing to be performed when the control input unit is interrupted.
Figure 21:
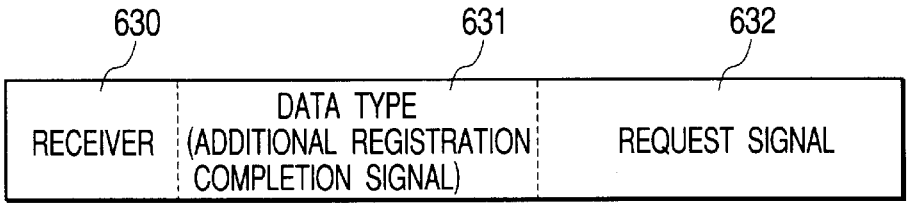
FIG. 21 shows the format of additional registration completion signals.
Figure 22:
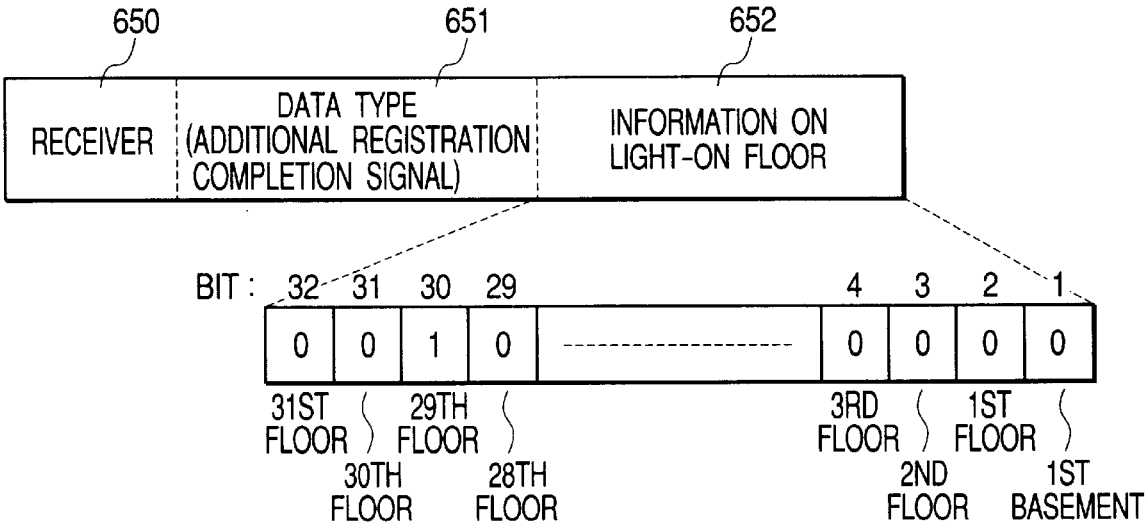
FIG. 22 shows the format of registered floor light-off signals.

A series of processing from the Steps 380 to 397 described above turn off all the destination floor response lights corresponding to the additionally registered floors having been added 1 to 2 seconds before. However, the destination floor response lights corresponding to the additionally registered floors are not turned off normally. This is because the additional registration completion signal having the format shown in FIG. 21 is sent from the controller 5 through the radio terminal 11 in response to the additionally registered floor signal. This processing will be explained with reference to FIG. 20: When the radio communications apparatus 160 has received a signal, a IRQ2 interrupt request is sent to the microcomputer 154. Upon receipt of the IRQ2 interrupt signal, the signal is captured from the radio communications apparatus, and the contents are analyzed in Step 601. Then in Step 602, evaluation is made to see if the signal is an additional registration completion signal or not. If it is an additional registration completion signal, the request number is taken out in Step 603. Then all bits for the additionally registered floor data of the Table 1 corresponding to the request number taken out in Step 604 are cleared, and the processing is now complete. This avoids turning off of the destination floor response light by a series of processing driven by the aforementioned IRQ5 interrupt. If the signal is not a additional registration completion signal according to evaluation in Step 602, processing goes to Step 606, and evaluation is made to see if the signal is a registered floor light-off signal or not. If it is a registered floor light-off signal, the light-off floor information is stored in the register R5. The light-off floor information is a bit string data where "1" is assigned to the bit corresponding to the destination floor response light to be turned off with the format as shown in FIG. 22. Then in Step 608, the logical NOT operation of the bit strings of the register R5 is implemented, and the result is stored in the register R5 again. Then in Step 609, the logical AND operation of the bit strings between the contents of the register R5 and current light-on contents is implemented, and the result is used to update the indicator. The processing is now complete. If the signal is not a registered floor light-off signal according to evaluation in Step 606, processing goes to Step 610. Here evaluation is made to see if the signal is a registered floor light-on signal or not. If it is a registered floor light-on signal, processing goes to Step 611, and the light-on floor information is stored in the register R5. Then in Step 612, the logical OR operation of the bit strings between the contents in the register R5 and current light-on contents is implemented and the result is used to update the indicator. The processing is now complete. If the signal is not a registered floor light-on signal according to revaluation in Step 610, processing terminates.

Figure 19:
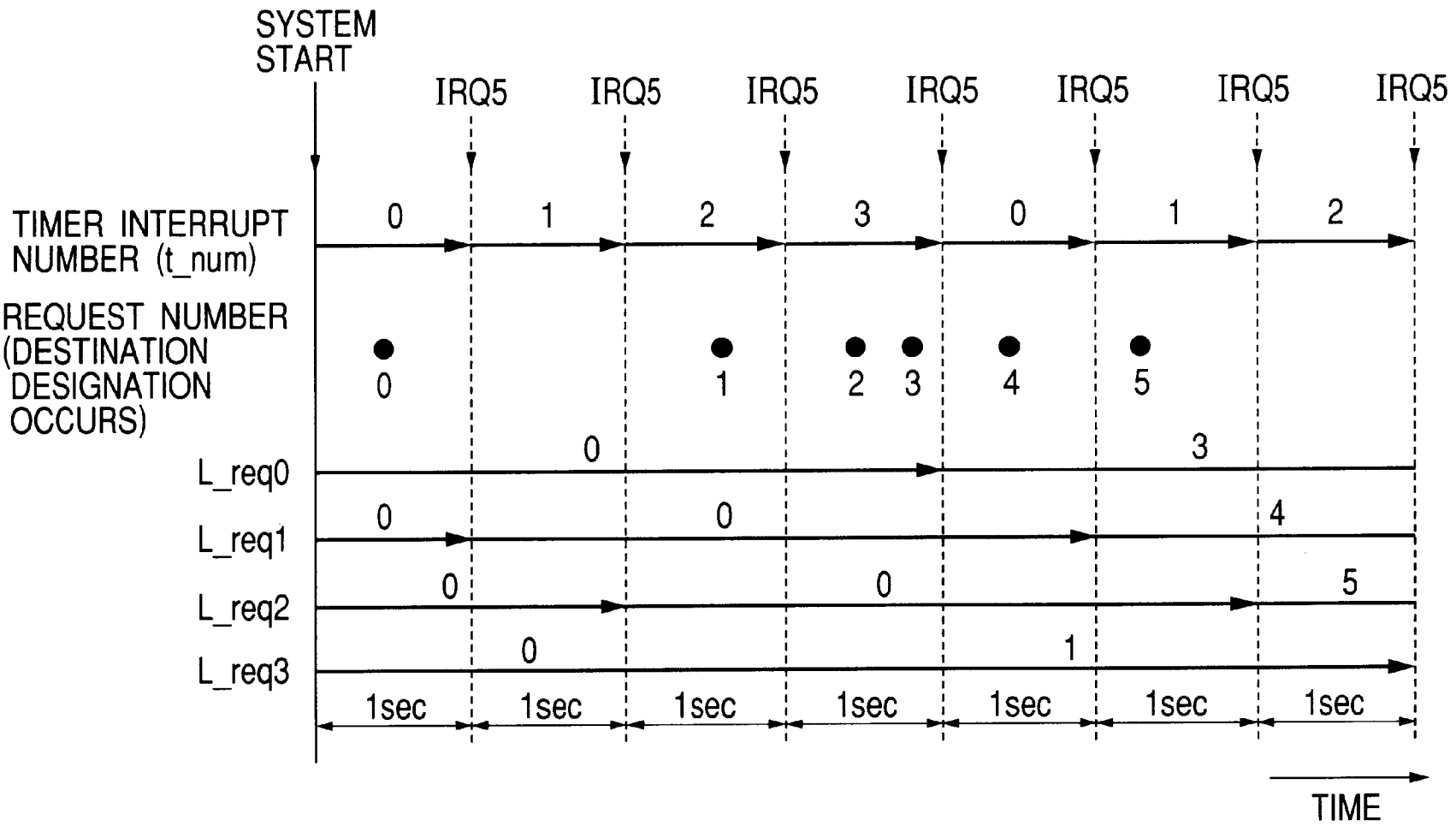
FIG. 19 shows the timing for timer interrupt number and request number.

With reference to FIG. 19, the following describes the generation of the aforementioned timer interrupt number t_num and the request number accompanying the issue of an additionally registered floor signal, and mutual timing of variables L_req0 to L_req3 updated for every timer interrupt. FIG. 19 shows the state from the start of the system. All the variables are initialized to zero, so t_num, request number, L_req0 to L_req3 are all zero (0) before the initial IRQ5 interrupt occurs. When the first IRQ5 has occurred, "1" is incremented to the timer interrupt number, with the result that t_num=1. In this case5, L_req1 is updated. Since the request number having been issued immediately before is 0, L_req1=0 remains unchanged. When the second IRQ5 interrupt occurs, it is updated and replaced by t_num=2. In this case, L_req2 is updated. However, since the request number has not yet issued subsequent to 0, the result is L_req2=0. When the third IRQ5 interrupt has occurred, it is updated and replaced by t_num=3. In this case, the updated L_req3=1, since the request number issued immediately before is the first. In this way, the request number occurred 1 to 2 seconds before can be identified by updating of L_req0 to L_req3 synchronized with the timer interrupt IRQ5. Thus, all the additionally registered floors occurred 1 to 2 seconds. before can be identified by making reference to the Table 2.

Figure 24:
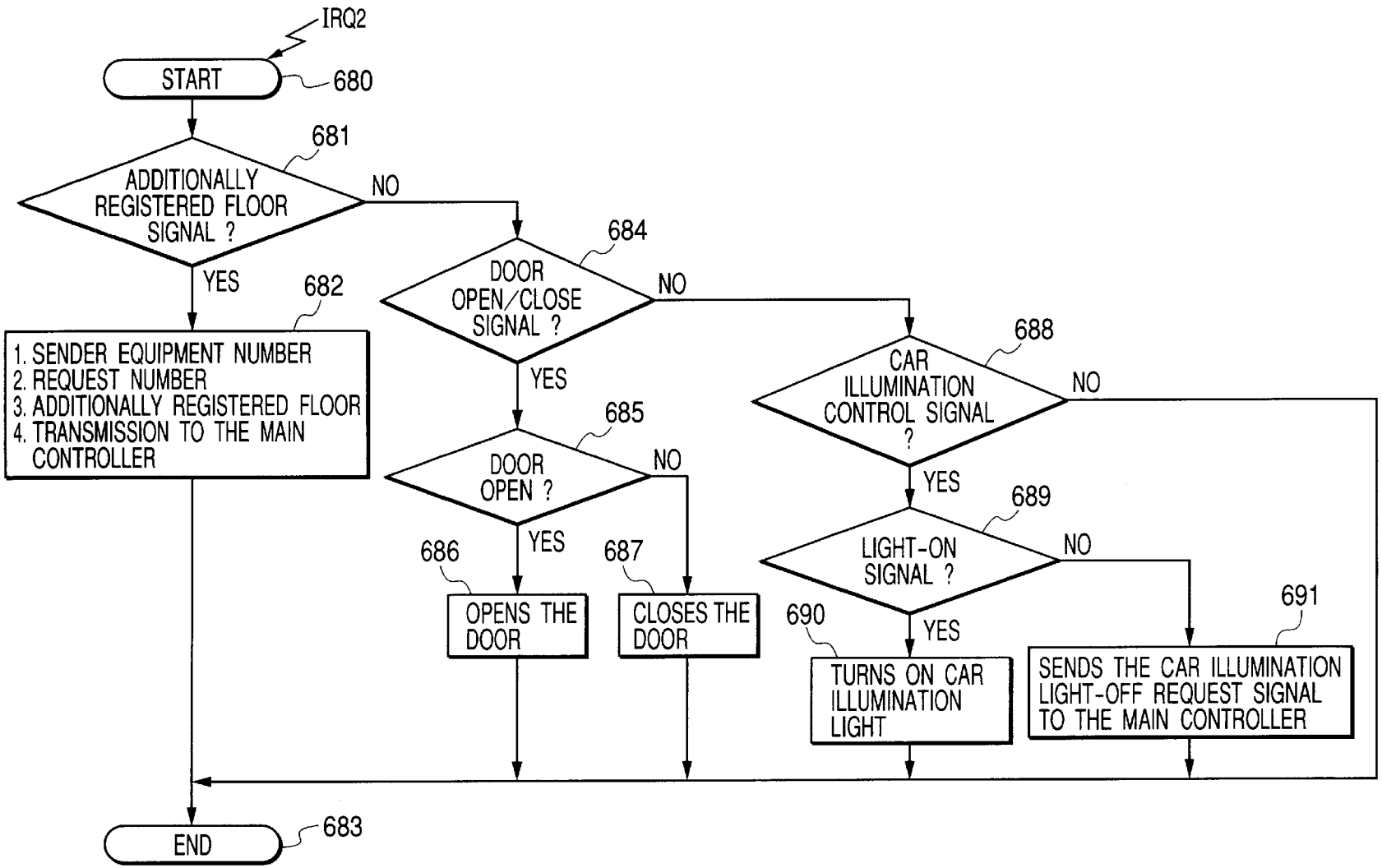
FIG. 24 shows the processing to be performed when the radio terminal is interrupted.

The above described the processing procedure inside the control input unit. With reference to FIGS. 24 and 25, the following describes the processing inside the microcomputer of the radio terminal 11 having the internal arrangement shown in FIG. 9. When the radio communications apparatus 160 has received the signal addressed to itself, IRQ2 interrupt request is issued to the microcomputer. Upon receipt of this IRQ2 interrupt, evaluation is made in Step 681 to see if the signal is an additionally registered floor signal or not, as shown in FIG. 24. If it is an additionally registered floor signal, the equipment number of the transmission source, request number and additionally registered floor data included in the received data are sent to the controller 5 in Step 682, and processing terminates. In the meantime, if the signal is not an additionally registered floor signal according to evaluation in Step 681, processing goes to Step 684, where evaluation is made to see if the signal is a door opening/closing signal or not. Here if the signal is a door opening/closing signal according to this evaluation, evaluation is made in Step 685 to see if the signal is a door-opening signal or not. If it is a door-opening signal according to this evaluation, processing goes to Step 686. The door is opened and processing terminates. If it is not a door-opening signal according to this evaluation in Step 687, the door is closed and processing terminates. If the signal is not a door opening/closing signal according to this evaluation Step 684, evaluation is made in Step 688 to see if the signal is a car illumination control signal or not. If it is a car illumination control signal according to this evaluation, evaluation is made in Step 689 to see if it is a light-on signal or not. If it is a light-on signal according to this evaluation, a car illumination light-on processing is performed and processing terminates. If it is not a light-on signal according to the evaluation in Step 689, car illumination light-off request signal is sent to the controller 5 in Step 691 and processing terminates. If it is not a car illumination control signal according to the evaluation in Step 688, processing terminates.

With reference to FIG. 25, the following describes the processing when the radio terminal receives a signal from the controller 5: Upon receipt of the IRQ7 interrupt. Data is captured from the controller and evaluation is made in Step 711 to see if it is an additional registration completion signal or not. The source of additional registration request (send-from), request number and additionally registered floor data are added to the additional registration completion signal received at this time. Here if it is an additional registration completion signal according to this evaluation, the additional registration completion signal together with the request number is sent to the source of additional registration request (send-from) in Step 712. (Processing of the source of request having received it has already been described in with reference to FIG. 20.) Then in Step 713, the registered floor light-on signal is sent as additionally registered floor data to the control input unit other than the source of request, and processing terminates. This allows information of destination floor registration button to be reflected also on the destination floor response light of the control input unit other than the source of request. If it is not a additionally registered floor data according to this evaluation in Step 711, evaluation is made in Step 715 to see if it is a registered floor light-off signal or not. If it is evaluated as a registered floor light-off signal, processing goes to Step 716, the registered floor light-off signal is sent to all control input units and processing terminates. If it is not a registered floor light-off signal according to the evaluation in Step 715, processing goes to Step 717, where evaluation is made to see if it is a car position signal or not. If it is a car position signal according to this evaluation, the car position signal is sent to the indicator 10. If it is not a car position signal according to the evaluation In Step 717, processing goes to Step 719, where evaluation is made to see if it is a door opening/closing signal or not. Here it is evaluated as a door opening/closing signal, evaluation is made in Step 720 to see if it is a door-opening signal or not. If it is a door-opening signal according to this evaluation, door-opening operation is performed in Step 721 and processing terminates. If it is not a door-opening signal according to the evaluation in Step 720, door closing operation is performed in Step 722 and processing terminates. If it is not a door opening/closing signal according to the evaluation in Step 719, processing goes to Step 723, where evaluation is made in Step to see if it is a car illumination control signal or not. If it is a car illumination control signal according to this evaluation, evaluation is made in Step 724 to see if it is an illumination light-on signal or not. If it is an illumination light-on signal, processing goes to Step 725. Car illumination light-on processing is performed and processing terminates. If it is not a illumination light-on signal according to the evaluation in Step 724, processing goes to Step 726. Car illumination light-off processing is performed and processing terminates. If it is not a car illumination control signal according to the evaluation in Step 723, processing terminates immediately.

Figure 26:
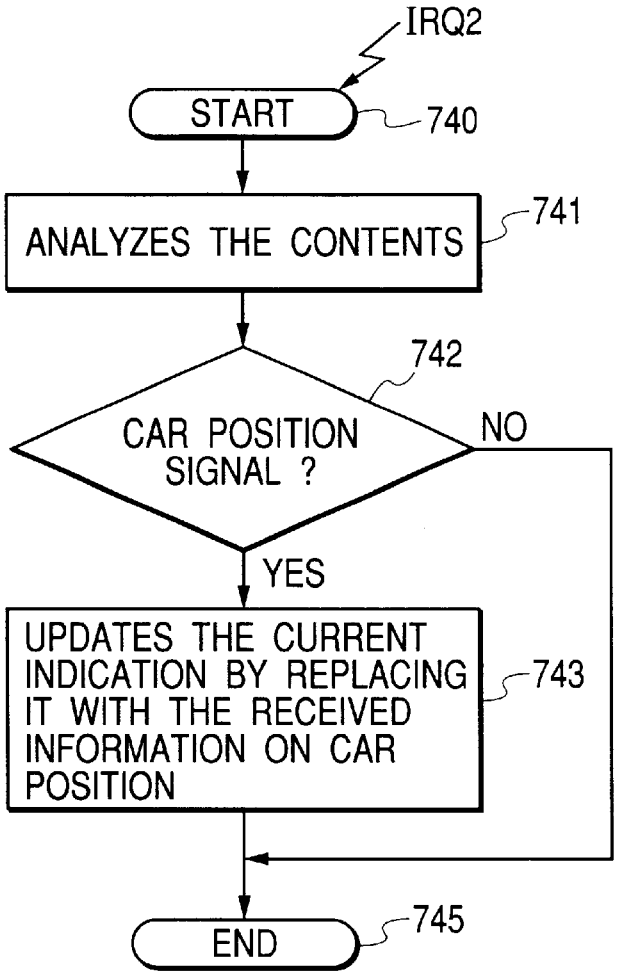
FIG. 26 shows the processing to be performed when the indicator terminal is interrupted.
Figure 27:
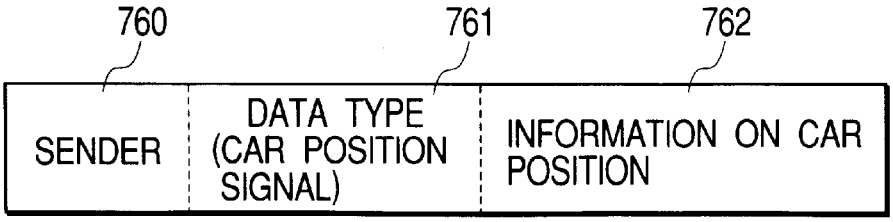
FIG. 27 shows the format of car position signals.

The above has described the processing of radio terminal 11. The following describes the processing inside the computer of the indicator having the internal arrangement shown in FIG. 11, with reference to FIG. 26: When the radio communications apparatus 160 has received the signal, IRQ2 interrupt request occurs to the microcomputer 154. Upon receipt of the IRQ2 interrupt, the signal is captured from the radio communications apparatus, and contents are analyzed in Step 741. Evaluation is made in Step 742 to see if it is a car position signal or not. If it is a car position signal according to this evaluation, processing goes to Step 743. The current indicator is updated and replaced by the received car position information, and processing terminates. FIG. 27 shows the format of the car position signal received at this time. If it is not a car position signal according to the evaluation in Step 742, processing terminates immediately.

Figure 28:
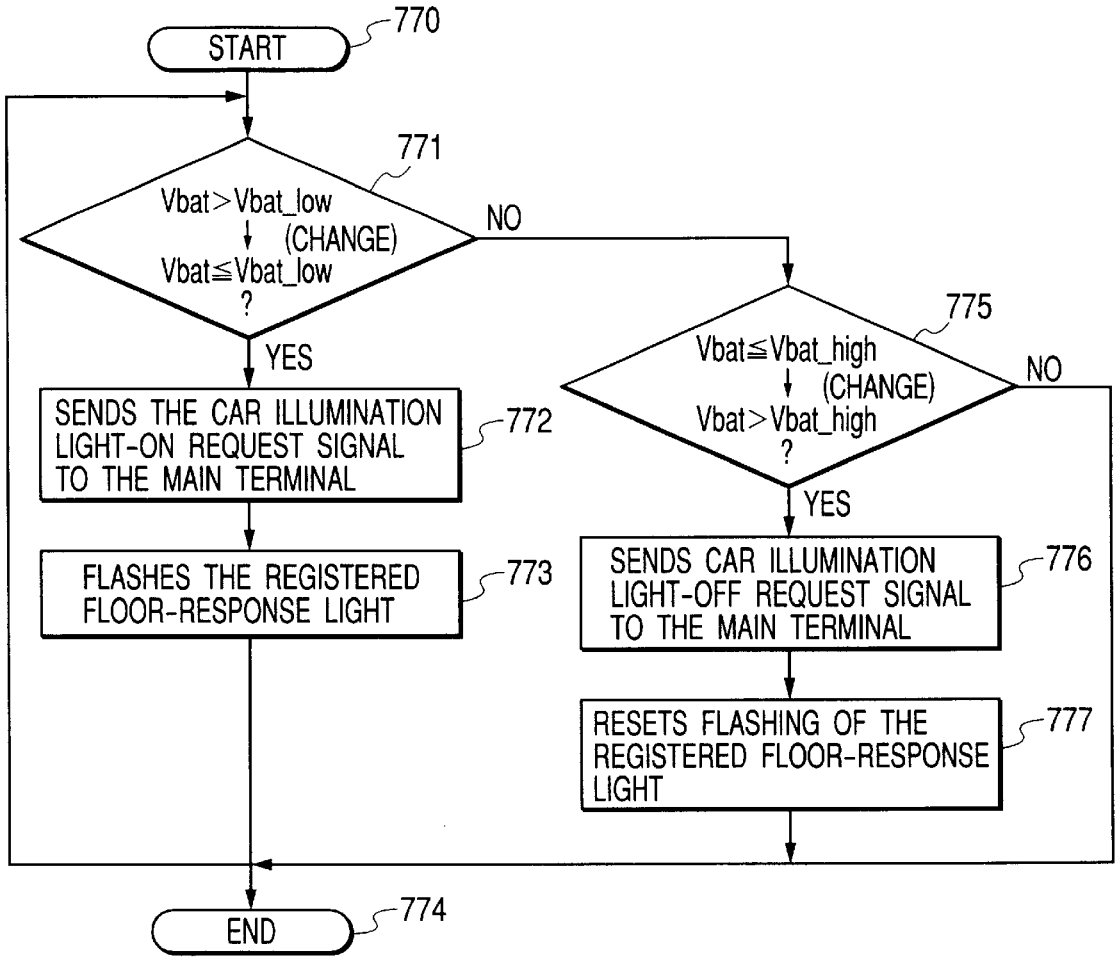
FIG. 28 shows the battery management for the operation panel.

The following describes the management of the remaining power of the secondary battery mounted on each operation panel with reference to FIG. 28. Battery management shown in FIG. 28 is implemented normally, or on a regular or irregular basis depending on the capacity of the secondary battery. If processing is performed, comparison is made between the Vbat representing the voltage across the terminal of secondary battery and Vbat_low representing the voltage value when there is a shortage of the remaining power of the battery in Step 771. Here if Vbat>Vbat_low in the previous processing has changed to Vbat<Vbat_low in the current processing, the remaining power of the battery is reduced below the specified value. So processing goes to Step 772, and the car illumination light-on request signal is sent to the radio terminal. Then in Step 773, the registered floor response light or car position indicator light is switched over to flashing mode, and processing terminates. Such flashing operation allows consumption of-the secondary battery to be reduced. If the evaluation conditions in Step 771 are not met, processing goes to Step 775. comparison is made between Vbat and Vbat_high representing the voltage value when there is a sufficient remaining power of the battery. Here if Vbat<Vbat_high in the previous processing has changed to Vbat>Vbat_high in the current processing, the battery has been charged sufficiently. So processing goes to Step 776. Otherwise, processing terminates. In Step 776, the car illumination light-off request signal is sent to the main terminal. Then processing goes to Step 777, and flashing of the registered floor response light or car position indicator light is rest.

Figure 29:
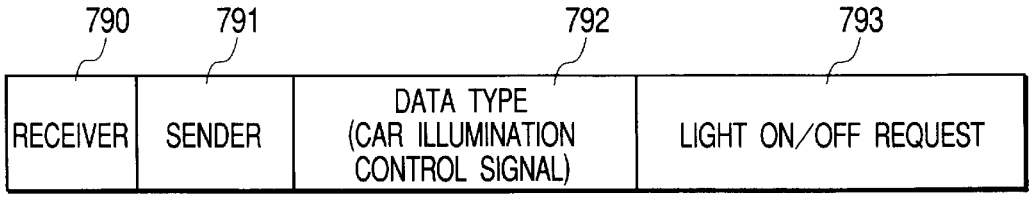
FIG. 29 shows the format of illumination control signals issued by the operation panel.

FIG. 29 shows the format of the car illumination control signal sent to the radio terminal by this processing.

Figure 30A:
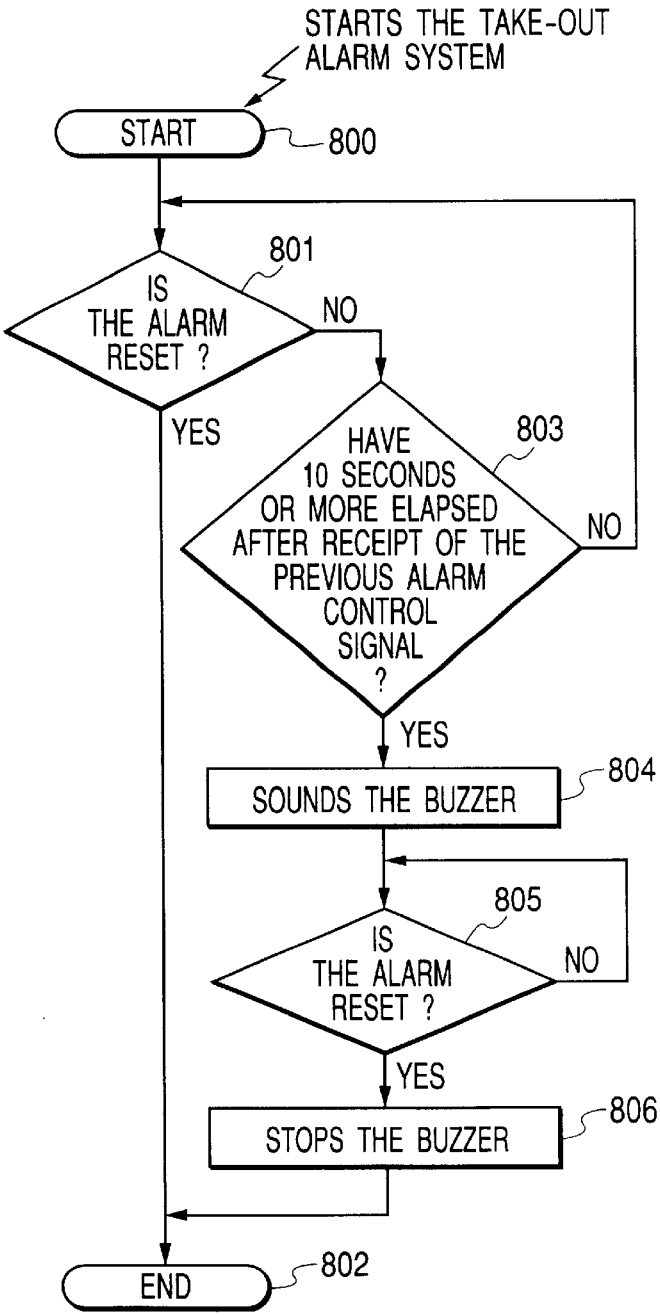
FIG. 30 shows the operation of the carry-out alarm system on the operation panel.
Figure 30B:
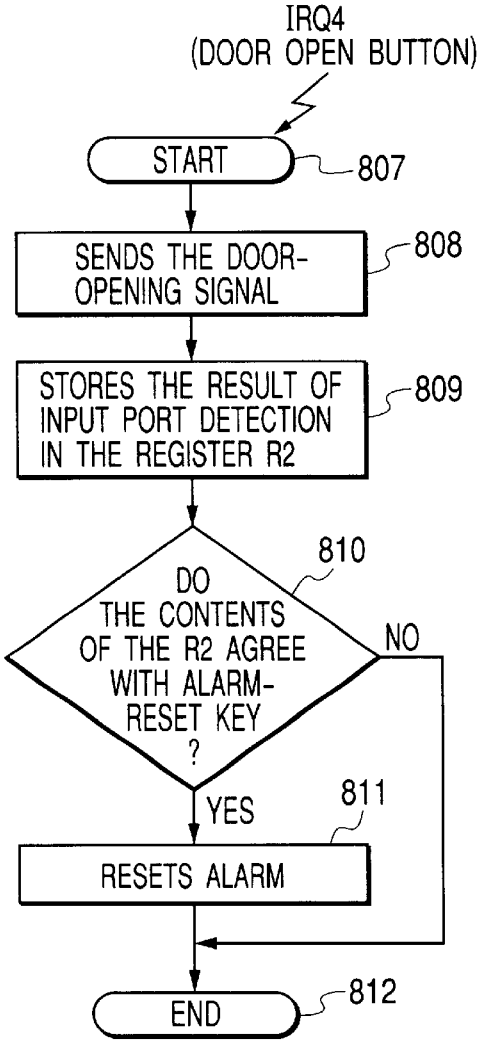

The following describes the arrangement of the alarm system mounted on the control input unit with reference to FIG. 30: In FIG. 30, (a) denotes the main processing of the carry-out alarm system, and (b) shows how alarm resetting is processed. In this alarm system, the buzzer does not produce sound while the alarm suppression signal sent at a certain interval (for example, 2 sec.) from the radio terminal is received. If the signal is not received for 10 seconds or more, the buzzer sounds. The alarm can be reset by pressing the door-opening button while pressing a specified combination of destination floor registration buttons at the same time. The following describes the details: When the carry-out alarm system has started, evaluation is made in Step 801 to see if alarm is reset or not. If it is reset according to the evaluation, the operation of the alarm system terminates. If it is not reset according to the evaluation in Step 801, processing goes to Step 803, where evaluation is made to see if 10 seconds or more have elapsed or not after the previous reception of an alarm suppression signal. If 10 seconds or more have elapsed, processing goes to Step 804 to cause the buzzer to sound. If 10 seconds or more have not elapsed according to the evaluation in Step 803, processing goes back to Step 801. When the buzzer has sounded in Step 804, processing goes to Step 805, and evaluation is made to see if the alarm is reset or not. If it is reset according to this evaluation, processing goes to Step 806. The buzzer stops and processing terminates. If the alarm is not reset according to the evaluation in Step 805, Step 805 is repeated. Until the alarm is evaluated as reset, buzzer stop processing in Step 806 does not take place. Alarm can be reset by pressing the door-opening button while pressing a combination of a fixed destination floor registration buttons (alarm reset keys) as mentioned above. In this case, the IRQ1 interrupt is received since the destination-opening registration button has been pressed. Because a greater priority is placed on the IRQ4 interrupt than IRQ1, the IRQ1 is suspended and processing goes to Step 807. Then transmission of the door-opening signal is started in Step 808, but this is irrelevant to alarm resetting.

Then in Step 809, the result of detecting the input port is stored in the register R2, and processing goes to Step 810, where evaluation is made to see if the contents of the R2 agree with the alarm reset key or not. It agreement is found, alarm is reset in Step 811 and processing terminates. If the contents of the R2 do not agree with the alarm reset key in Step 810, processing terminates immediately.

The radio communications apparatus of the operation panel sends the radio signal for turning on the illuminating light inside the car in the event that the remaining power of the secondary battery has reduced below a specified value as mentioned above. This function is applicable not only to the present embodiment, but also to an elevator communications apparatus which comprises a secondary battery for supplying power to the radio communications apparatus and operation panel and a solar battery for charging, and which communicates with the elevator controller through this radio communications apparatus. Further, the indicator light or response light of the operation panel flashes when the remaining power of the secondary battery has reduced below a specified value. This function is applicable to an elevator communications apparatus which comprises a secondary battery for supplying power to the radio communications apparatus and operation panel and a solar battery for charging, and which communicates with the elevator controller through this radio communications apparatus. Further, the operation panel produces alarm when the operation panel is about to be removed from the wall surface inside the car where it is installed or to be carried out of the car after being removed, or it has been actually carried out of the car. This function is applicable not only to the present embodiment, but also to an elevator communications apparatus which comprises a radio communications apparatus and which communicates with the elevator controller through this radio communications apparatus.

Figure 31:
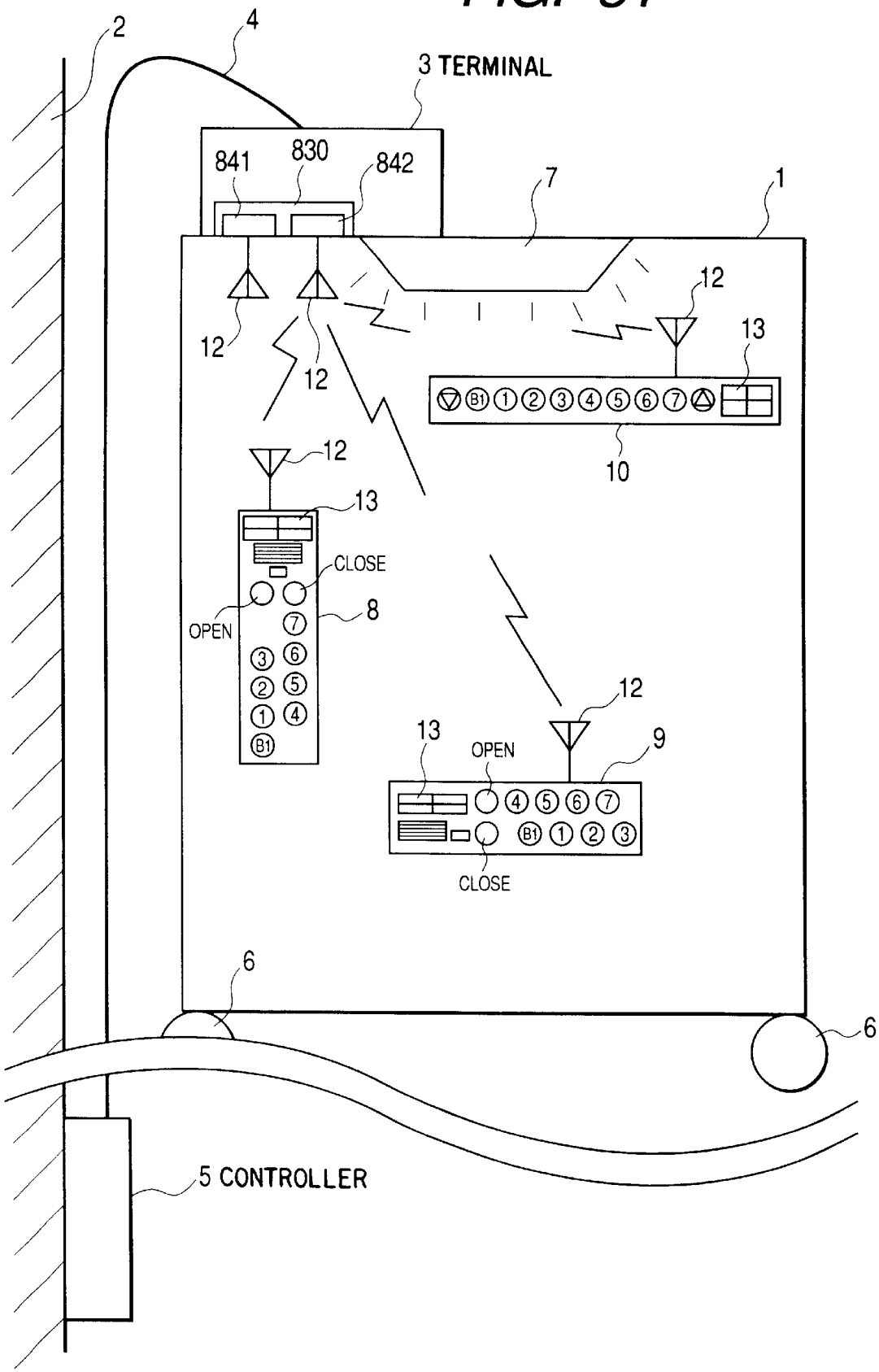
FIG. 31 is a diagram representing a second embodiment according to the present invention.

FIG. 31 shows the second embodiment of the present invention wherein the radio communications apparatus inside the radio terminal is designed in a redundant configuration. In FIG. 31, numeral 841 denotes a radio communications apparatus A and 842 a radio communications apparatus B. Other codes are used in the same meaning as those in FIG. 1. The radio communications apparatus A and radio communications apparatus B have the same functions, and their functions are the same as those of the radio communications apparatus 160 as described above. Normally, either of these radio communications apparatuses is used. Assume that the radio communications apparatus A is the one normally used.

Figure 32:
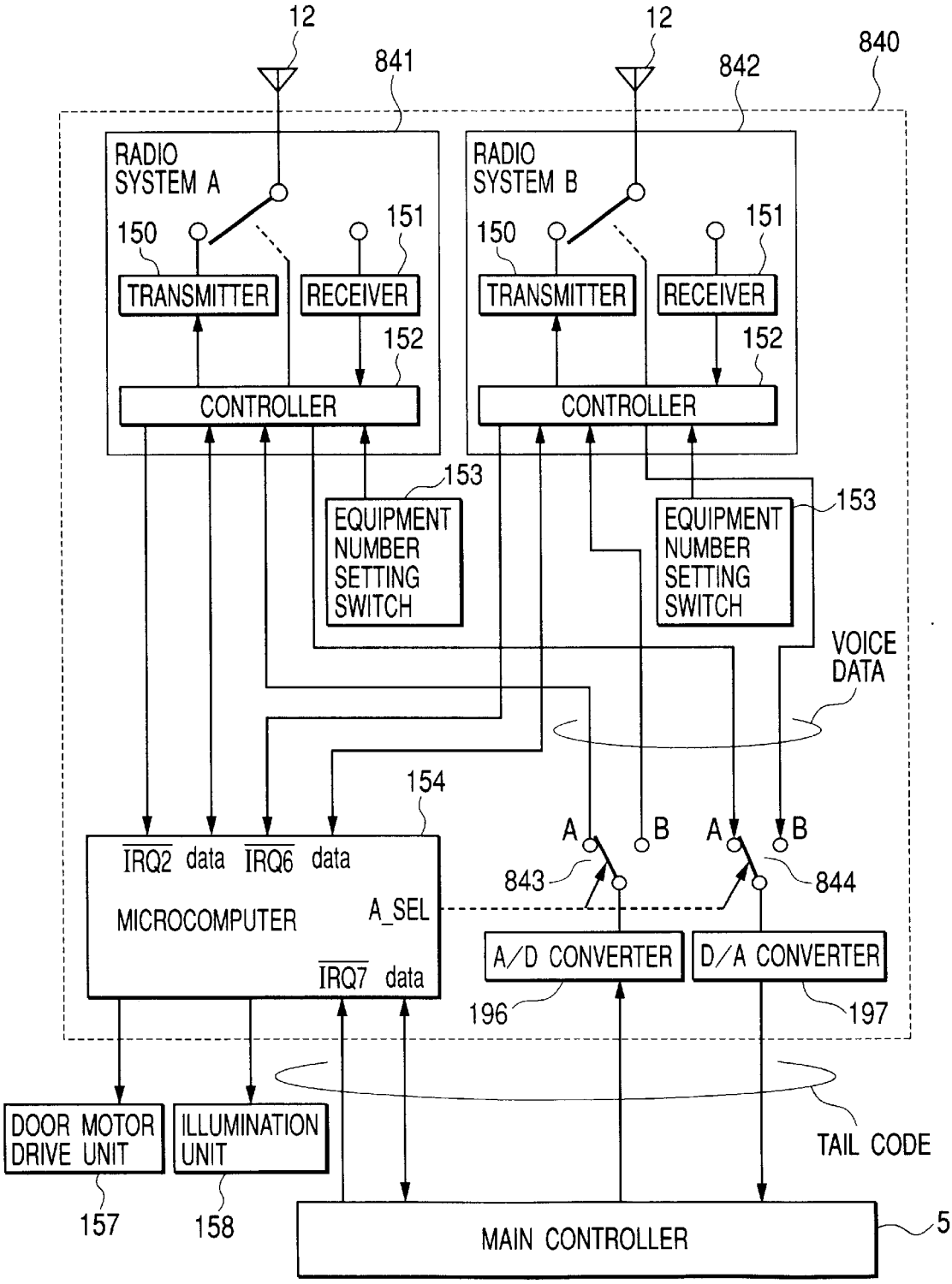
FIG. 32 shows the internal structure of a radio terminal in the second embodiment of the invention.

FIG. 32 shows the internal arrangement of the radio terminal when a radio communications apparatus is designed in a redundant configuration. In FIG. 32, numeral 196 denotes an A/D converter which converts into the digital signal the analog signal sent from the controller 5. Its function is the same as that of the A/D converter 155 explained with reference to FIG. 9. Numeral 197 denotes an D/A converter which converts into the analog signal the digital voice signal sent from the radio communications apparatus. Its function is the same as that of the D/A converter explained with reference to FIG. 9. Numeral 843 denotes a switch for switching between the radio communications apparatuses A and B according to the destination of the signal output from the A/D converter 196. Numeral 844 denotes a switch for switching between the radio communications apparatuses A and B according to the source of voice data to be input into the D/A converter 197. This is a new addition of an IRQ6 interrupt terminal not found in FIG. 9. This is the interrupt request signal which calls out the same function as that of the interrupt IRQ2 as described above.

Figure 33:
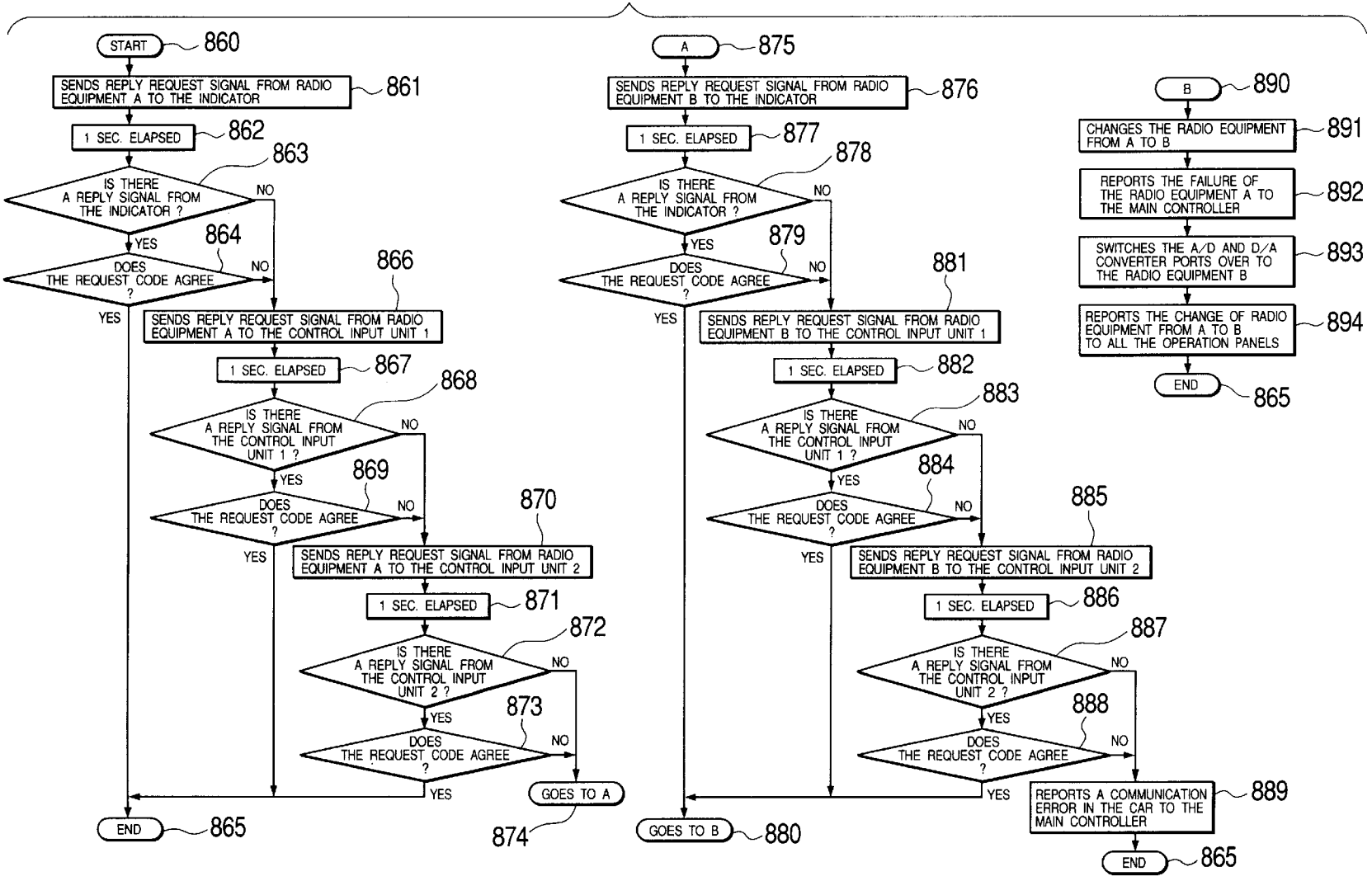
FIG. 33 shows the processing of failure detection and switching in the second embodiment of the invention.
Figures 34, 35:
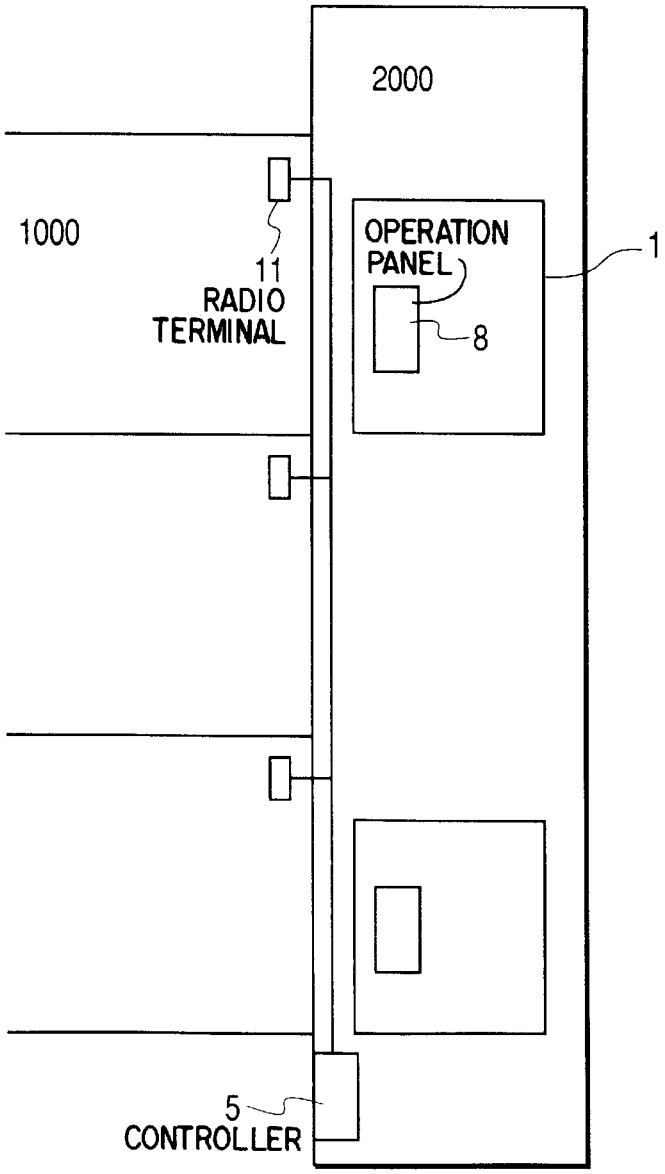
FIG. 34 shows the format of return request signals.
FIG. 35 is a diagram representing a third embodiment according to the present invention.

With reference to FIG. 33, the following describes processing when the radio communications apparatus is designed in a redundant configuration: What is shown in FIG. 33 is the processing of correct detection of a failure in the radio communications apparatus A and selection of the radio communications apparatus B. This function of failure detection and selection is implemented on a regular or irregular basis at a frequency without hindering the normal processing. When processing is started in Step 860, processing goes to Step 861, and the return request signal is sent from the radio communications apparatus A to the indicator. The format of this return request signal consists of Receiver 900, Sender 901, Data type 902 and Return request code 903, as shown in FIG. 34. In this return request signal, the Receiver (destination) is assigned to the indicator, the Sender (source) is assigned to the radio communications apparatus A and a certain number is assigned is assigned to the return request code; then the signal is transmitted. Upon receipt of the signal, the operation panel assigns the return request code to the return request response signal and returns it. After waiting for 1 second in Step 862, evaluation is made in Step 863 to see if there is any return signal from the indicator or not. If there is a return signal, processing goes to Step 864, evaluation is made to see if the received return signal request code agrees with the sent code or not. If agreement is found, processing terminates immediately. If there is no return signal from the indicator in Step 863 or if there is no agreement between the return request code and the code sent in Step 864, processing goes to Step 866, where the return request signal is sent from the radio communications apparatus A to the control input unit 1. After that, the same processing done to the indicator 2 in Steps 867 to 869 is repeated. If there is a return signal and agreement is found with the request code, the radio communications apparatus A is not faulty, so processing terminates. Conversely, if there is no return signal or code agreement, the same return request signal is sent to the control input unit 2 (Steps 870 to 873). Here if there is still no return signal or code agreement, processing goes to Step 876.

In Step 876, the return signal request signal is sent from the radio communications apparatus B to the indicator. After waiting for 1 second in Step 877, evaluation is made in Step 878 to see if there is a return signal from the indicator. If there is, evaluation is made in Step 879 to see if there is agreement of the request code or not. If there is agreement, processing goes to Step 891. Then the radio communications apparatus to be used is switched from A to B. In Step 878. If there is no return signal from the indicator or there is no agreement of the request code in Step 879, processing goes to Step 881. The return signal request signal is sent from the radio communications apparatus B to the control input unit 1. After the lapse of 1 second, evaluation is made in Step 883 to see if there is a return signal. If there is, evaluation is made in Step 884 to see if there is agreement of the request code or not. If there is, processing goes to Step 891, and the radio communications apparatus to be used is switched from A to B. In Step 873. If there is no return signal or there is no agreement of the request code in Step 884, the return signal request signal is sent from radio communications apparatus B to control input unit 2 in Step 885. After waiting for 1 second in Step 886, evaluation is made in Step 887 to see if there is a return signal. If there is, evaluation is made to see if there is agreement between the code received in Step 888 and the sent code or not. If there is agreement, processing goes to Step 891, and the radio communications apparatus to be used is switched from A to B. If there is no return signal from the control input unit 2 according to the evaluation in Step 887, processing goes to Step 889 where a communications error in the car is reported to the controller 5 and processing terminates. After the radio communications apparatus has been switched from A to B in Step 891, the failure of the radio communications apparatus A is reported to the controller 5 in Step 892. Then in Step 893 the A/D and D/A conversion ports of FIG. 32 are set to the radio communications apparatus B by means if switches 843 and 844. Then in Step 894 that the radio communications apparatus of the radio terminal has been changed from A to B is reported to all the operation panels. In response to this report, all the operation panels change the destination of the main radio terminal from the radio communications apparatus A to the radio communications apparatus B.

FIG. 35 shows a third embodiment of the present invention. The elevator car 1 moves in the vertical direction through the hoist-way 2000 installed in the 3-story building. For the sake of expediency, this one drawing is used to show the cases where the cars 1 are approaching the first and third floors. In the present embodiment, a radio terminal 11 is provided at the passenger entrance of 1000 each floor. In the same way as the aforementioned embodiment, the operation panel 8 provided with the radio communications apparatus is installed inside the car 1. Further, the radio terminal 11 and elevator controller 5 communicates with each other by radio. When the car 1 is located close to the passenger entrance, namely, when one of the radio terminals 11 moves close to the operation panel 8, the radio terminal 11 and operation panel 8 communicate with each other by radio through the radio communications apparatus built in each of them.

The operation panel 8 and radio terminal 11 communicate with each other when they are close to each other. Communications between the operation panel 8 and radio terminal 11 is less affected by external noise. Furthermore, similarly to the aforementioned embodiment, short range radio transmission as in small-power radio transmission can be applied to radio communications between the two. FIG. 35 shows a communications apparatus in an elevator installed a 3-story building, but not limited thereto. The present embodiment is applicable to an elevator installed in a building with any number of stories. A radio terminal 11 need not be installed for each passenger entrance on each floor if short range radio transmission is applicable, namely, if the operation panel 8 and radio terminal 11 communicate with each other when they are placed close to each other. FIG. 35 shows only one operation panel. However, multiple operation panels 8, 9 and 10 can be installed, as shown in FIG. 1. The present invention allows the number of wires in the car to be reduced. Furthermore, reliability or dependability of communications is improved because the operation panel and terminal communicate with each other at a shorter distance.

What is claimed is:

1. An elevator communications apparatus comprising;

an operation panel provided in the car of an elevator and containing a radio communications apparatus, and a terminal for communications with said operation panel by short-range radio via said radio communications apparatus;

said elevator communications apparatus characterized in that signals related to said communications are exchanged between the controller of said elevator and said terminal.

2. An elevator communications apparatus comprising;

an operation panel provided in the car of an elevator and containing a radio communications apparatus, and a terminal provided in said car for communications with said operation panel by radio via said radio communications apparatus;

said elevator communications apparatus characterized in that signals related to said communications are exchanged between the controller of said elevator and said terminal.

3. An elevator communications apparatus comprising;

an operation panel provided in the car of an elevator and containing a radio communications apparatus, and a terminal provided outside said car for communications with said operation panel by short-range radio via said radio communications apparatus when approaching said operation panel;

said elevator communications apparatus characterized in that signals related to said communications are exchanged between the controller of said elevator and said terminal.

4. An elevator communications apparatus according to claim 3 characterized in that said terminal is installed on the passenger entry side of the elevator.

5. An elevator communications apparatus according to claim 1, characterized in that said operation panel is a control input unit or indicator.

6. An elevator communications apparatus according to claim 1, wherein a pair of the frequency band and intensity of electric field is one of the following pairs, that is:

the frequency band, 322 MHz or less, of said radio communications apparatus, and intensity of electric field, 35 $\mu$V/m, or less, 3 meters away from said radio communications apparatus;

the frequency band from, 322 M to 10 GHz, of said radio communications apparatus, and intensity of electric, field, 35 $\mu$V/m or less, 3 meters away from said radio communications apparatus; and the frequency band, 10 G to 150 GHz, of said radio communications apparatus, and intensity of electric field, 500 $\mu$V/m or less, 3 meters away from said radio communications apparatus; and the antenna power of said radio communications apparatus is 10 mW or less.

7. An elevator communications apparatus according to claim 1, characterized in that said operation panel produces alarm when brought outside.

8. An elevator communications apparatus according to claim 1, further comprising a secondary battery for supplying power to said operation panel and a solar battery for charging said secondary battery;

wherein, when the remaining power of said secondary battery has reduced below the specified value, said radio communications apparatus sends a radio signal for turning on the illuminating light in said car.

9. An elevator communications apparatus according to claim 1, further comprising a secondary battery for supplying power to said operation panel;

said elevator communications apparatus further characterized in that, when the remaining power of said secondary battery has reduced below the specified value, the indicator light or response light of said operation panel flashes.

10. An elevator communications apparatus comprising;

an operation panel provided in the car of an elevator and containing a radio communications apparatus, and a terminal for communications with said operation panel by radio via said radio communications apparatus;

wherein a pair of the frequency band and intensity of electric field is one of the following pairs, that is:

the frequency band, 322 MHz or less, of said radio communications apparatus, and intensity of electric field, 500 $\mu$V/m or less, 3 meters away from said radio communications apparatus;

the frequency band, from 322 M to 10 GHz, of said radio communications apparatus, and intensity of electric field, 35 $\mu$V/m or less, 3 meters away from said radio communications apparatus;

the frequency band, from 10 G to 150 GHz or less, of said radio communications apparatus, and intensity of electric field, 500 $\mu$V/m, 3 meters away from said radio communications apparatus; and the antenna power of said radio communications apparatus is 10 mW or less.

11. An elevator communications apparatus comprising;

an operation panel which is provided in the car of an elevator, contains a radio communications apparatus, and communicates with the controller of said elevator;

wherein said operation panel produces alarm when brought outside.

12. An elevator communications apparatus comprising;

an operation panel which is provided in the car of an elevator, contains a radio communications apparatus, and communicates with the controller of said elevator, a secondary battery for supplying power to said operation panel, and a solar battery for charging said secondary battery;

wherein, when the remaining power of said secondary battery has reduced below the specified value, said radio communications apparatus sends a radio signal for turning on the illuminating light in said car.

13. An elevator communications apparatus comprising;

an operation panel which is provided in the car of an elevator, contains a radio communications apparatus, and communicates with the controller of said elevator, and a secondary battery for supplying power to said operation panel;

said elevator communications apparatus further characterized in that, when the remaining power of said secondary battery has reduced below the specified value, the indicator light or response light of said operation panel flashes.

* * * * *